US008572865B2

(12) United States Patent
Beers et al.

(10) Patent No.: US 8,572,865 B2
(45) Date of Patent: Nov. 5, 2013

(54) APPARATUS AND METHOD FOR USING A HYBRID DRYER TUB FOR AIRFLOW IMPROVEMENT

(75) Inventors: David Beers, Louisville, KY (US); Nicholas Okruch, Jr., Mount Washington, KY (US)

(73) Assignee: General Electric Company, Schenectady, NY (US)

( * ) Notice: Subject to any disclaimer, the term of this patent is extended or adjusted under 35 U.S.C. 154(b) by 380 days.

(21) Appl. No.: 12/915,146

(22) Filed: Oct. 29, 2010

(65) Prior Publication Data

US 2012/0102781 A1 May 3, 2012

(51) Int. Cl.
*F26B 11/02* (2006.01)

(52) U.S. Cl.
USPC ..... 34/601; 34/606; 34/610; 68/20; 62/176.6; 237/2 B

(58) Field of Classification Search
USPC ..... 34/90, 138, 595, 601, 606, 610; 62/160, 62/176.6, 178, 190; 68/19.1, 196, 20; 237/2 B
See application file for complete search history.

(56) References Cited

U.S. PATENT DOCUMENTS

| | | | | |
|---|---|---|---|---|
| 2,369,366 | A * | 2/1945 | O'Neill | 34/267 |
| 2,676,418 | A * | 4/1954 | Shewmon | 34/77 |
| 3,036,383 | A * | 5/1962 | Edwards | 34/76 |
| 4,603,489 | A * | 8/1986 | Goldberg | 34/77 |
| 4,665,628 | A | 5/1987 | Clawson | |
| 5,806,204 | A * | 9/1998 | Hoffman et al. | 34/92 |
| 7,194,823 | B2 * | 3/2007 | Nakamoto et al. | 34/526 |
| 7,325,333 | B2 * | 2/2008 | Tadano et al. | 34/604 |
| 7,921,578 | B2 * | 4/2011 | McAllister et al. | 34/597 |
| 2006/0218812 | A1 * | 10/2006 | Brown | 34/86 |
| 2007/0039198 | A1 | 2/2007 | Boettcher | |

FOREIGN PATENT DOCUMENTS

| | | | |
|---|---|---|---|
| CH | 701466 | A2 * | 12/2010 |
| DE | 4212697 | A1 * | 10/1993 |
| EP | 548035 | A1 * | 6/1993 |
| EP | 1209277 | A2 * | 5/2002 |
| JP | 2004097388 | A * | 4/2004 |
| WO | WO 03057968 | A1 * | 7/2003 |

* cited by examiner

*Primary Examiner* — Steve M Gravini
(74) *Attorney, Agent, or Firm* — Global Patent Operations; Douglas D. Zhang

(57) ABSTRACT

An apparatus includes a mechanical refrigeration cycle arrangement having a working fluid and an evaporator, a condenser, a compressor, and an expansion device, cooperatively interconnected and containing the working fluid. The apparatus also includes a sensor located to sense at least one parameter, a controller coupled to said sensor and said compressor, a drum to receive clothes to be dried, wherein a rear portion of the drum is equipped with multiple perforations, and a perimeter portion of the drum is equipped with multiple perforations, and a duct and fan arrangement configured to pass air over said condenser and through said drum, wherein the duct and fan arrangement is configured to facilitate airflow through the perforations on the rear portion of the drum into the drum, and out of the drum through the perforations on the perimeter portion of the drum to enable an increased airflow without an increased power input.

22 Claims, 24 Drawing Sheets

RELATIVE PRESSURE DROPS IN GRILLS OF THE HEAT PUMP DRYER AIR CIRCUIT

| | PROTO 2 | | | | PROTO 4 PROTO 3 | | PROTO 4 PROTO 3 | | |
|---|---|---|---|---|---|---|---|---|---|
| | BASIC SUPPLY GRILL | BASIC RETURN GRILL | FIXED REAR DRUM SUPPLY GRILL | FIXED REAR DRUM SUPPLY GRILL FULL | 3 SPOKE GRILL | 3 SPOKE GRILL WITH /INSERT SPECIAL | HPD RETURN GRILL | HYBRID RETURN GRILL SPECIAL | |
| # OF HOLES = | 312 | 120 | 390 | 594 | 991 | 285 | 195 | | cnt |
| DIAMETER = | 0.25 | 0.125 | 0.25 | 0.25 | 0.25 | 0.25 | 0.5 | 0.25 | in |
| HEIGHT = | | 0.375 | | | | | 0.5 | | in |
| AREA = | 15.31526 | 11.25 | 19.14408 | 29.15791 | 48.6456 | 122.4 | 48.75 | 259.2 | $in^2$ |
| | 0.106356 | 0.078125 | 0.132945 | 0.202485 | 0.337817 | 0.85 | 0.338542 | 1.8 | |
| | | | 0.64 | 0.27589 | 0.09912 | 0.015656 | 0.053254 | 0.001884 | ratio |
| | | | | | | 9.5 | | | |
| | | | | | | 4 | | | |
| | | | | | | 15 | | 72 | in |
| | | | | | | 4 | | 4 | in |
| | | | | INSERT AREA = | | 204 | | 432 | $in^2$ |
| | | | | OPEN RATIO = | | 0.6 | | 0.6 | ratio |
| | | | | OPEN AREA = | | 122.4 | | 259.2 | $in^2$ |

FIG. 15

RELATIVE PRESSURE DROPS IN GRILLS OF THE HEAT PUMP DRYER AIR CIRCUIT

| | BASIC SUPPLY GRILL | 3 SPOKE GRILL | 3 SPOKE GRILL WITH /INSERT |
|---|---|---|---|
| AREA = | 15.32 | 48.65 | 122.40 |
| PRESSURE RATIO = | | 0.09912 | 0.015656 |

| | |
|---|---|
| AVG SIDE | 9.5 |
| HEIGHT | 4 |
| BASE | 15 |
| HEIGHT | 4 |
| INSERT AREA = | 204 |
| OPEN RATIO = | 0.6 |
| OPEN AREA = | 122.4 |

| | BASIC RETURN GRILL | HYBRID RETURN GRILL | LOWER ACCEPT LIMIT FOR HYBRID |
|---|---|---|---|
| | 11.25 | 259.20 $in^2$ | 111.60 $in^2$ |
| | | 0.001884 ratio | 0.010162 ratio |
| PERIM | | 72 in | 62 |
| WIDTH | | 4 in | 2 |
| | | 432 $in^2$ | 186 |
| | | 0.6 ratio | 0.6 |
| | | 259.2 $in^2$ | 111.6 |

FIG. 16

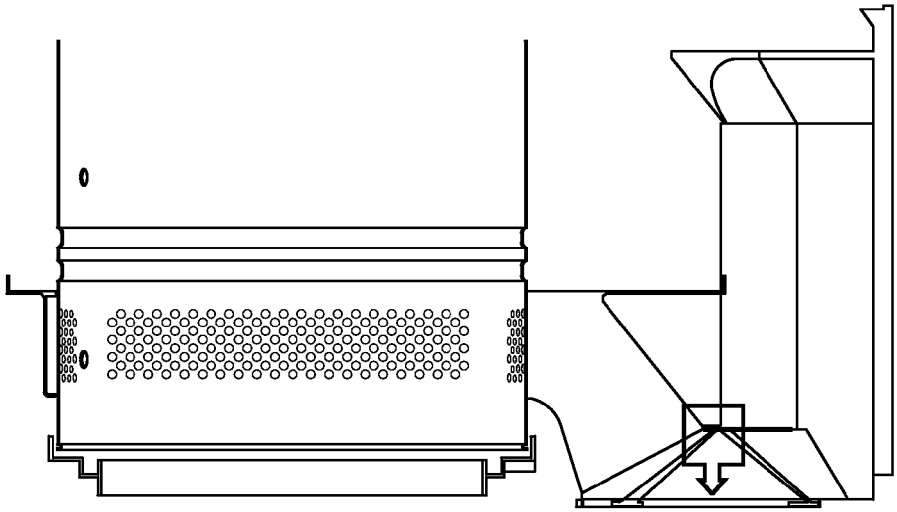
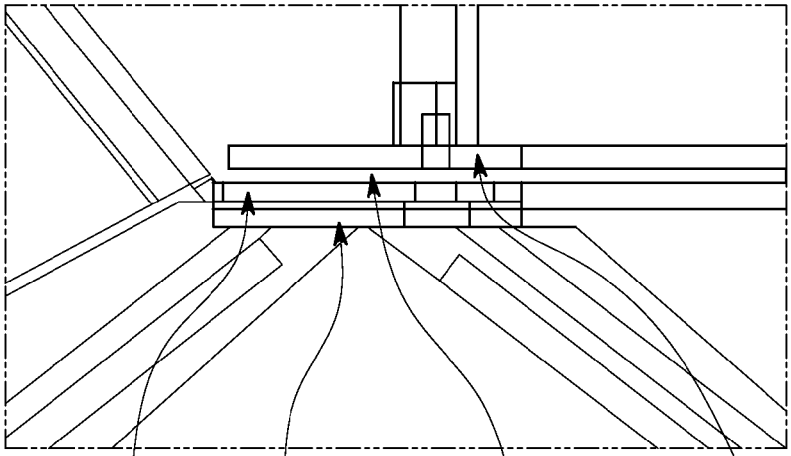
FIG. 17

ISOMETRIC VIEW
(RIGHT SIDE)

| | HEATER | DRUM INLET GRILL | DRUM OUTLET GRILL | FILTER | EVAP COIL | COND COIL | |
|---|---|---|---|---|---|---|---|
| CMF = | 300 | 300 | 300 | 300 | 300 | 300 | |
| #OPENINGS = | | 390 | 120 | | | | |
| X OR D = | | 0.25 | 0.25 | | | | |
| Y = | | | 0.25 | | | | |
| OPEN AREA = | | 19.1 | 7.5 | | | | $in^2$ |
| WETTED PERIMETER = | | 306.3 | 120 | | | | in |
| T = | | | | | | | |
| $\rho$ = | 0.063 | 0.063 | 0.063 | 0.063 | 0.063 | 0.063 | |
| $\nu$ = | | 37.6 | 96 | | | | ft/sec |
| Re = | | | | | | | |
| $\Delta P$ = | | 0.309 | 2.016 | | | | $lb_f/in^2$ |
| | | 0.0111 | 0.0726 | | | | $in/H_2O$ |

FIG. 24

APPARATUS AND METHOD FOR USING A HYBRID DRYER TUB FOR AIRFLOW IMPROVEMENT

BACKGROUND OF THE INVENTION

The subject matter disclosed herein relates to appliances using a mechanical refrigeration cycle, and more particularly to heat pump dryers and the like.

Clothes dryers have typically used electric resistance heaters or gas burners to warm air to be used for drying clothes. These dryers typically work on an open cycle, wherein the air that has passed through the drum and absorbed moisture from the clothes is exhausted to ambient. More recently, there has been interest in heat pump dryers operating on a closed cycle, wherein the air that has passed through the drum and absorbed moisture from the clothes is dried, re-heated, and re-used.

Commercial dryers include perforations and are equipped with a so-called "double tub," wherein if dripping wet laundry is placed into a commercial dryer, the water goes through the perforations, collects and is drained away in the outer drum. This is advantageous because airflow can be introduced from the top and out the bottom, or in on the sleeve and out on the perimeter, or in the center and out the perimeter, at very high airflow rates, because there is almost no pressure drop. However, the double-tub construction is quite expensive.

For residential dryers, existing approaches for increases in grill area have had only marginal improvements in airflow at the expense of consumer access to the drum.

BRIEF DESCRIPTION OF THE INVENTION

As described herein, the exemplary embodiments of the present invention overcome one or more disadvantages known in the art.

One aspect of the present invention relates to a method comprising the steps of, in a heat pump clothes dryer operating on a mechanical refrigeration cycle, equipping a rear portion of a drum in the heat pump clothes dryer with multiple perforations, equipping a perimeter portion of the drum in the heat pump clothes dryer with multiple perforations, and facilitating airflow through the drum of the heat pump clothes dryer to enable an increased airflow without an increased power input, wherein facilitating airflow comprises directing airflow through the multiple perforations on the rear portion of the drum into the drum, and out of the drum through the multiple perforations on the perimeter portion of the drum.

Another aspect relates to an apparatus comprising: a mechanical refrigeration cycle arrangement having a working fluid and an evaporator, a condenser, a compressor, and an expansion device, cooperatively interconnected and containing the working fluid. The apparatus also includes a sensor located to sense at least one parameter, a controller coupled to said sensor and said compressor, a drum to receive clothes to be dried, wherein a rear portion of the drum is equipped with multiple perforations, and a perimeter portion of the drum is equipped with multiple perforations, and a duct and fan arrangement configured to pass air over said condenser and through said drum, wherein the duct and fan arrangement is configured to facilitate airflow through the perforations on the rear portion of the drum into the drum, and out of the drum through the perforations on the perimeter portion of the drum to enable an increased airflow without an increased power input.

Yet another aspect relates to an apparatus comprising: a drum to receive clothes to be dried, wherein a rear portion of the drum is equipped with multiple perforations, and a perimeter portion of the drum is equipped with multiple perforations, and a duct and fan arrangement configured to pass air through said drum, wherein the duct and fan arrangement is configured to facilitate airflow through the perforations on the rear portion of the drum into the drum, and out of the drum through the perforations on the perimeter portion of the drum to enable an increased airflow without an increased power input.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

BRIEF DESCRIPTION OF THE DRAWINGS

In the drawings:

FIG. 15 presents a table illustrating relative pressure drops in heat pump dryer grills, in accordance with a non-limiting exemplary embodiment of the invention;

FIG. 16 presents a chart illustrating relative pressure drops in heat pump dryer grills, in accordance with a non-limiting exemplary embodiment of the invention;

FIG. 17 presents an example return duct, in accordance with a non-limiting exemplary embodiment of the invention;

FIG. 24 presents a chart illustration of perforation area calculation by a spreadsheet using simple area formulas, in accordance with a non-limiting exemplary embodiment of the invention;

DETAILED DESCRIPTION OF THE EXEMPLARY EMBODIMENTS OF THE INVENTION

As detailed herein, description of one or more embodiments of the invention within the context of a heat pump dryer serves merely as one non-limiting example implementation for purposes of illustration, and it should be appreciated that one or more embodiments of the invention can be applied to multiple types of dryers (such as for example, electric resistance heater dryers, gas burner dryers, etc.).

Figure 1:
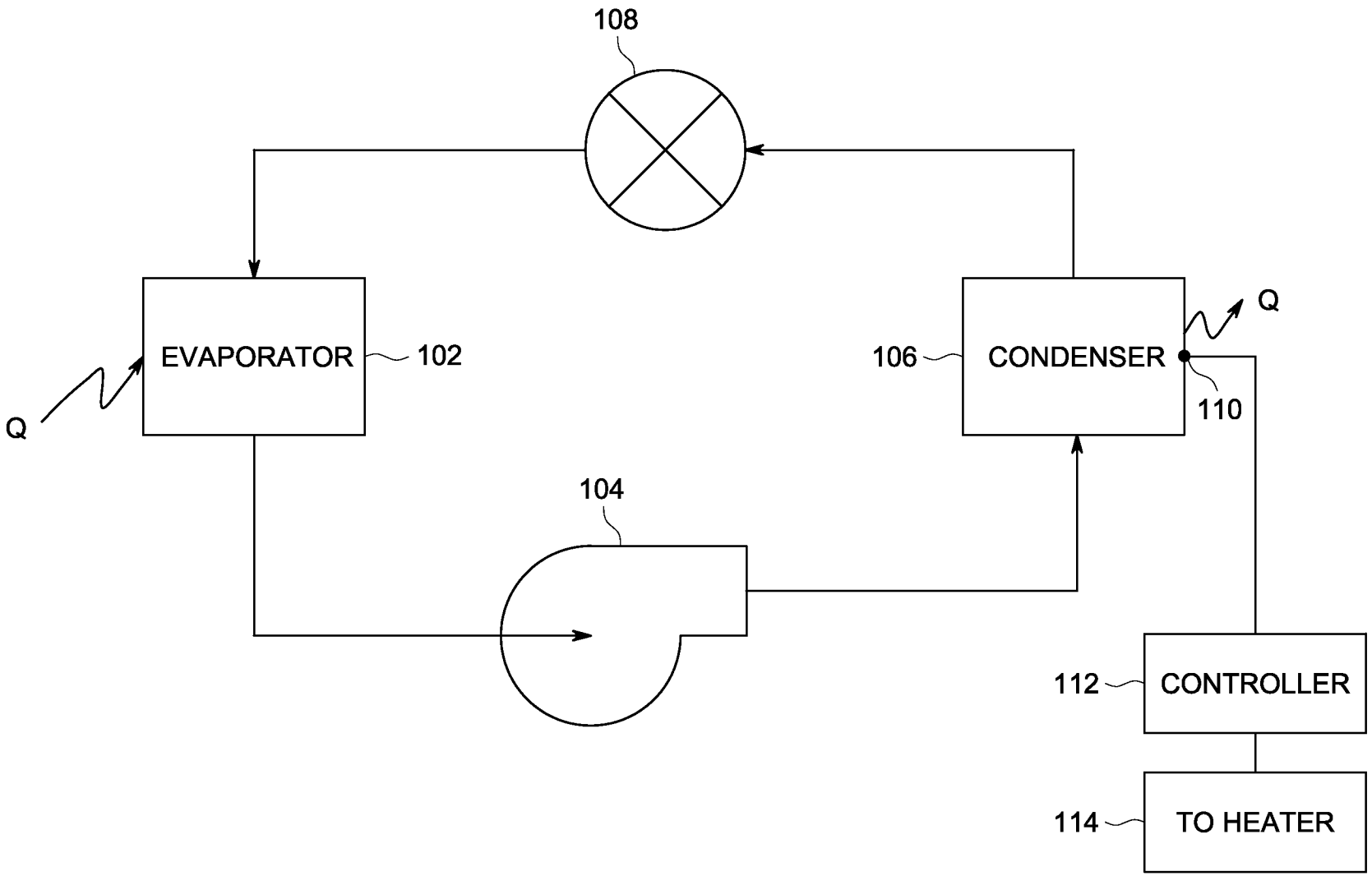
FIG. 1 is a block diagram of an exemplary mechanical refrigeration cycle, in accordance with a non-limiting exemplary embodiment of the invention.

FIG. 1 shows an exemplary embodiment of a mechanical refrigeration cycle, in accordance with an embodiment of the invention. Heat (Q) flows into evaporator 102, causing refrigerant flowing through same to evaporate and become somewhat superheated. The superheated vapor is then compressed in compressor 104, and flows to condenser 106, where heat (Q) flows out. The refrigerant flowing through condenser 106 condenses and becomes somewhat sub-cooled. It then flows through restriction 108 and back to evaporator 102, competing the cycle. In a refrigerator, freezer, or air conditioner, evaporator 102 is located in a region to be cooled, and heat is generally rejected from condenser 106 to ambient. In a heat pump, heat is absorbed from the ambient in evaporator 102 and rejected in condenser 106 to a space to be heated.

In the non-limiting exemplary embodiment of FIG. 1, a temperature or pressure sensor 110 is located in the center of the condenser 106 and is coupled to a controller 112 which, as indicated at 114, in turn controls an auxiliary heater, to be discussed in connection with FIG. 2.

In review, a mechanical refrigeration system includes the compressor 104 and the restriction 108 (either a capillary or a thermostatic expansion valve or some other kind of expansion valve or orifice—a mass flow device just before the evaporator 102 which limits the mass flow and produces the pressures in the low side and high side). The condenser 106 and the evaporator 102 are heat exchange devices and they regulate the pressures. The mass transfer devices 104, 108 regulate the mass flow. The pressure in the middle of the condenser 106 will be slightly less than at the compressor outlet due to flow losses.

Figure 2:
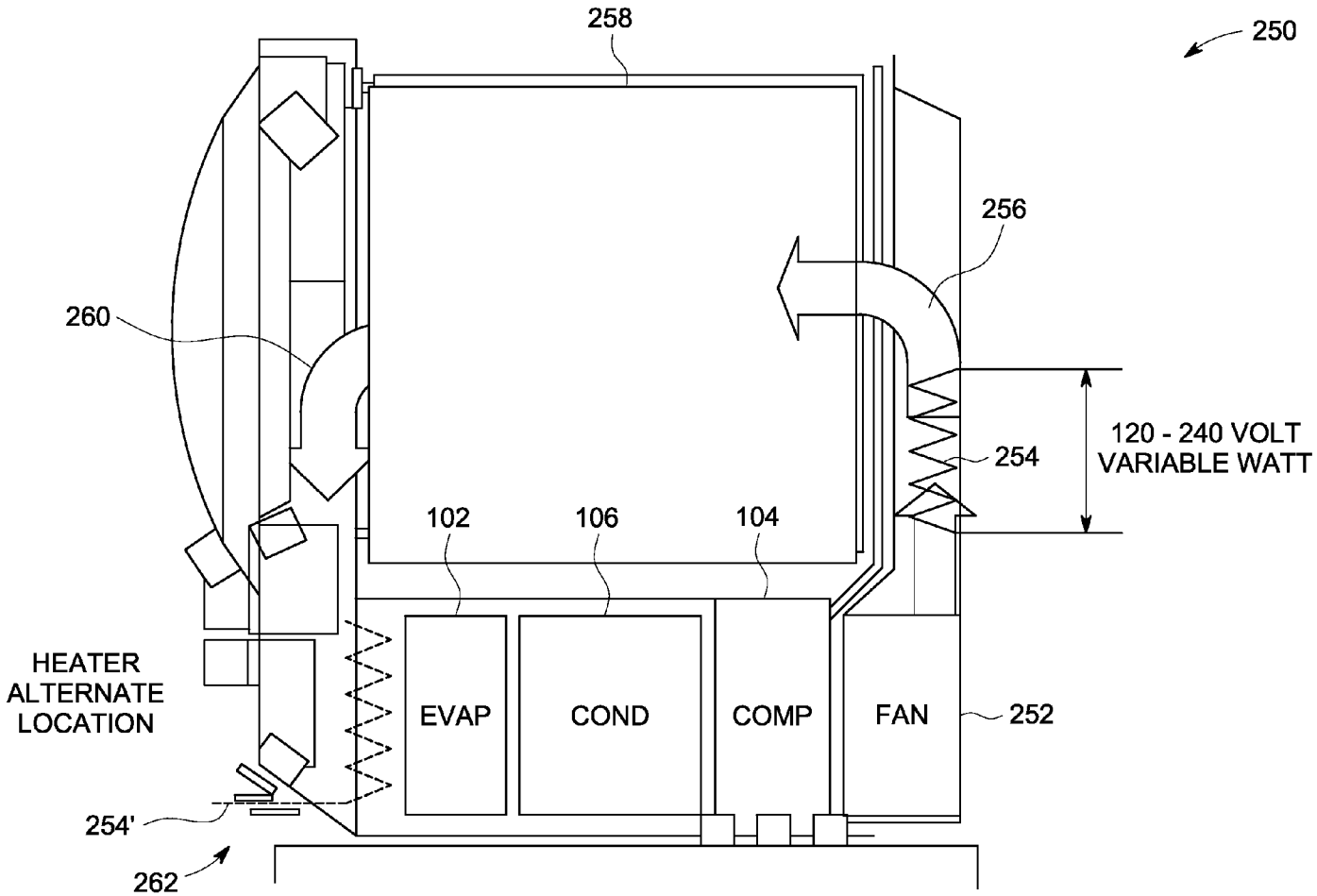
FIG. 2 is a semi-schematic side view of a heat pump dryer, in accordance with a non-limiting exemplary embodiment of the invention.

FIG. 2 shows an exemplary embodiment of a heat pump type clothes dryer 250. The evaporator 102, condenser 106, and compressor 104 are as described above with respect to FIG. 1. The refrigerant lines and the expansion valve 108 are omitted for clarity. Fan 252 circulates air through a supply duct 256 into drum 258 to dry clothes contained therein. The mechanism for rotating the drum 258 can be of a conventional kind and is omitted for clarity. Air passes through the drum 258 into a suitable return plenum 260 and then flows through a return duct 262. Condenser 106 is located in the air path to heat the air so that it can dry the clothes in the drum 258.

One or more embodiments include an auxiliary heater 254 in supply duct 256 and/or an auxiliary heater 254' in return duct 262; in either case, the heater may be controlled by controller 112 as discussed elsewhere herein.

One or more embodiments advantageously improve transient performance during start-up of a clothes dryer, such as dryer 250, which works with a heat pump cycle rather than electric resistance or gas heating. As described with respect to 254, 254', an auxiliary heater is placed in the supply and/or return duct and used to impact various aspects of the startup transient in the heat pump drying cycle.

With continued reference to FIG. 1, again, compressor 104 increases the pressure of the refrigerant which enters the condenser 106 where heat is liberated from the refrigerant into the air being passed over the condenser coils. The fan 252 passes that air through the drum 258 to dry the clothes. The air passes through the drum 258 to the return duct 262 and re-enters or passes through the evaporator 102 where it is cooled and dehumidified (this is a closed cycle wherein the drying air is re-used). In some instances, the heater can be located as at 254, in the supply duct to the drum (after the fan 252 or between the condenser 106 and the fan 252). In other instances, the heater can be located at point 254', in the return duct from the drum 258, just before the evaporator 102.

Thus, one or more embodiments place a resistance heater of various wattage in the supply or return duct of a heat pump dryer to provide an artificial load through the drum 258 to the evaporator 102 by heating the supply and therefore the return air, constituting a sensible load to the evaporator 102 before the condenser 106 is able to provide a sensible load or the clothes load in drum 258 is able to provide a latent psychrometric load. This forces the system to develop higher temperatures and pressures earlier in the run cycle, accelerating the onset of drying performance.

A refrigeration system normally is run in a cycling mode. In the off cycle it is allowed to come to equilibrium with its surroundings. A system placed in an ambient or room type environment will seek room temperature and be at equilibrium with the room. When the system is subsequently restarted, the condenser and evaporator will move in opposite directions from the equilibrium pressure and temperature. Thus, the evaporator will tend towards a lower pressure and/or temperature and the condenser will seek a higher temperature and/or pressure. The normal end cycle straddles the equilibrium pressure and steady state is reached quite quickly.

In one or more embodiments, for system efficiency in a heat pump dryer, operating points that result in both the condenser and evaporator pressures and temperatures being above the equilibrium pressure of the system in the off mode are sought.

Figure 3:
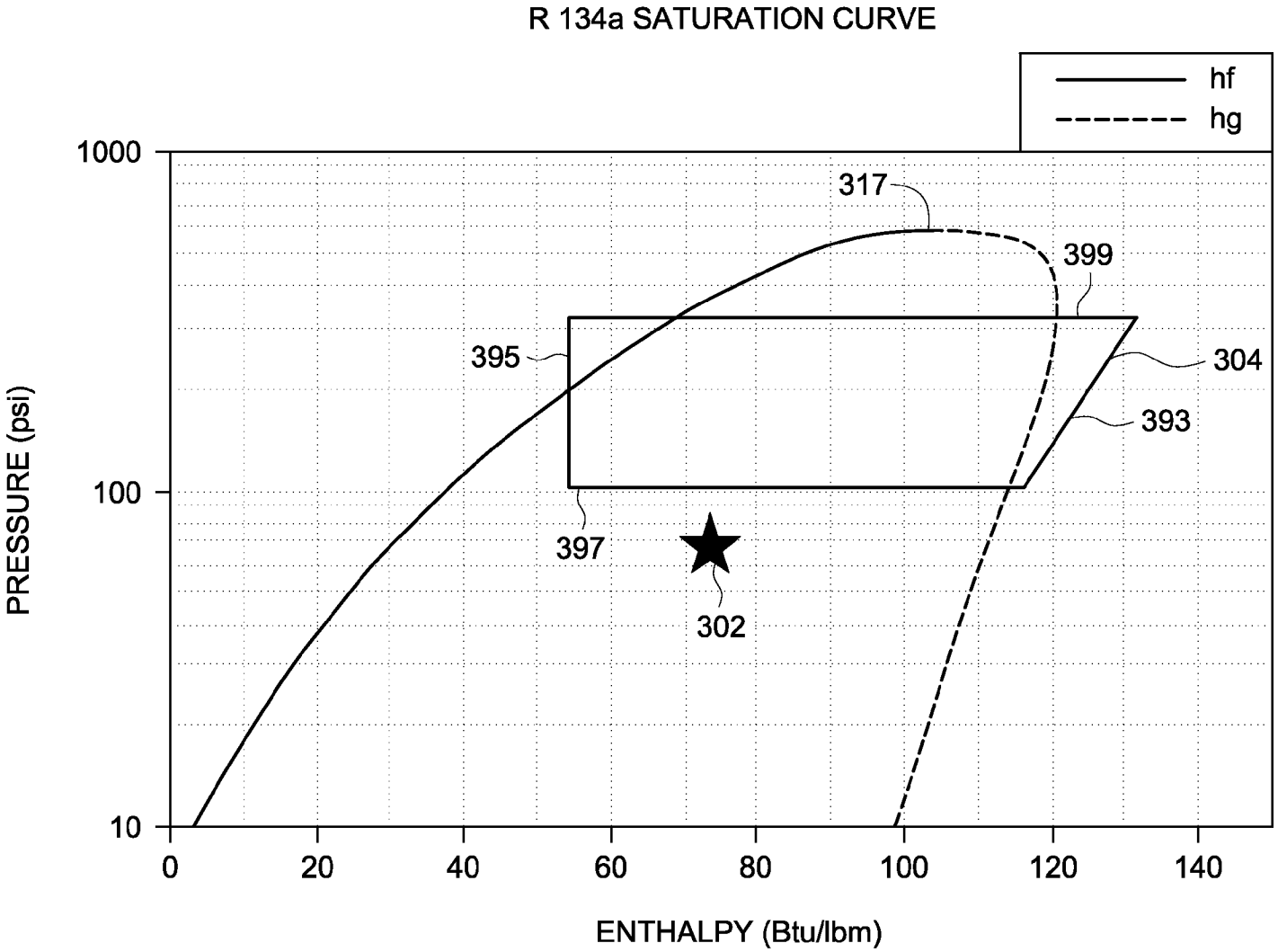
FIGS. 3 and 4 are pressure-enthalpy diagrams illustrating refrigerant cycle elevation, in accordance with a non-limiting exemplary embodiment of the invention.
Figure 4:
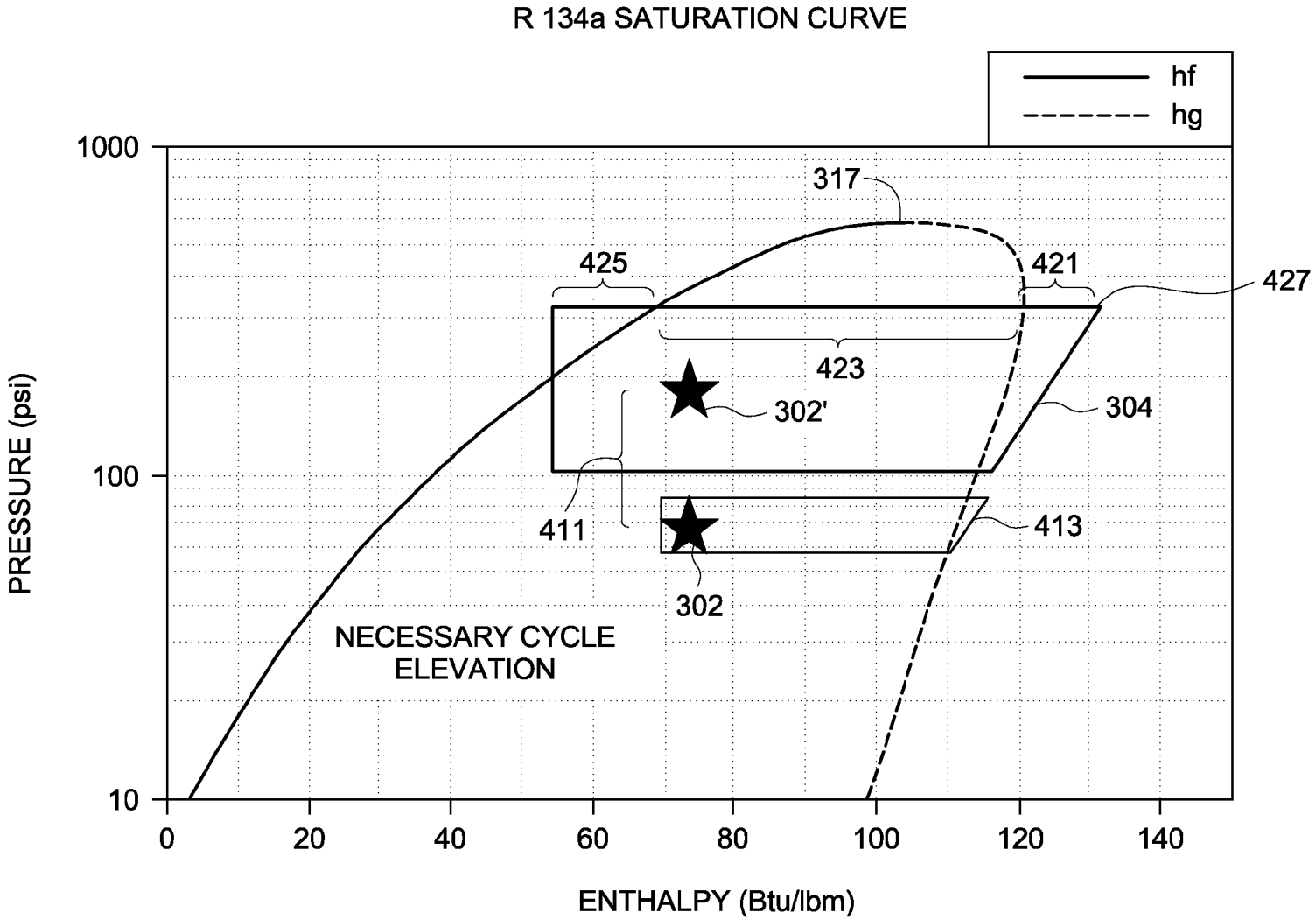

Placing a heater in the supply duct to the drum of a heat pump dryer heats the air up well above ambient temperature as it is presented to the evaporator. If the heater is on at the start of a drying cycle the heat serves to begin the water extraction process in the clothes by evaporation in combination with the airflow by diffusion. The fact that more water vapor is in the air, and the temperature is higher than would otherwise be the case, causes the evaporator to "see" higher temperature than it would otherwise "see." The temperature of the evaporator will elevate to meet the perceived load, taking the pressure with it. Thus the temperature and pressure of the refrigerant are elevated above the ambient the refrigerant would otherwise seek as shown in FIGS. 3 and 4 and described in greater detail below.

With each subsequent recirculation of the air, a higher level is reached until leakage and losses neutralize the elevating effects. Since a suitably sealed and insulated system will not lose the accumulated heat, the cycle pressure elevation can continue until a quite high pressure and temperature are reached. Thus, the refrigeration system moves into a regime where compressor mass flow is quite high and power consumed is quite low.

With the heater on, the system moves to a higher total average pressure and achieves such a state considerably faster than in a conventional system. This is brought about by supplying the evaporator a definite and instantaneous load. This loading causes the heat exchangers (i.e., evaporator 102 and condenser 106) to react and supply better properties to accelerate mass flow through the mass flow devices (the compressor 104 and restrictor 108).

Elevation of a refrigerant cycle's pressures within the tolerance limits of the refrigerant boosts compressor capacity at approximately equal power consumption. Thus, in one or more embodiments, the efficiency of refrigeration cycles is improved as pressures are elevated.

Given the teachings herein, the skilled artisan will be able to install, control, and protect a suitable heater with minimal cost, and will also be able to interconnect the heater with the control unit for effective control.

Refer to the P-h (pressure-enthalpy) diagram of FIG. 3. The star 302 represents the equalization condition. In refrigerators and other refrigeration devices such as air conditioners, dehumidifiers, and the like, a cycle is typically started up around the equalization point. When the compressor starts, it transfers mass from the evaporator or low pressure side, to the high pressure side (condenser). The condenser rejects heat and the evaporator absorbs heat, as described above. Generally, the source temperatures for the heat exchangers are found inside the cycle curve 304. The diagram of FIG. 3 illustrates, rather than lowering (the evaporator pressure) and raising (the condenser pressure) pressures from equilibrium, elevating the cycle 304 completely (i.e., both low 397 and high 399 pressure sides) above the equalization pressure at star 302. To accomplish this, provide the aforementioned auxiliary heat source to raise the cycle to a different starting state by preloading the evaporator and causing the system to migrate to a higher pressure-temperature cycle.

Refer now to the P-h diagram of FIG. 4, the necessary cycle elevation is given by the bracket 411 between the two stars 302, 302'. Typically, the system will start in a cycle 413 surrounding the equalization point, which is the lower star 302. Because of the auxiliary heater (which in one or more embodiments need provide only a faction of the power actually needed to dry the clothes), the cycle elevates and spreads to the desired upper envelope 304. By way of review, if the auxiliary heater was not applied, operation would be within the lower cycle 413 wherein, shortly after startup, the upper pressure is between 80 and 90 PSI and the lower pressure is between 50 and 60 PSI. Note that these values would eventually change to an upper pressure of about 150 PSI and a lower pressure of about 15 PSI when a steady state was reached. Thus, without the extra heater, the steady state cycle obtained would have a high side pressure of about 150 PSI and a low side pressure of about 15 PSI. Upper envelope 304 shows the results obtained when the auxiliary heater is used. Eventually, the auxiliary heater is preferably shut off to prevent the compressor overheating. Thus, for some period of time during the startup transient, apply extra heat with the auxiliary heater, causing the heat pump to operate in a different regime with a higher level of pressure.

For completeness, note that upper envelope 304 represents, at 393, a compression in compressor 104; at high side 399, condensation and sub-cooling in condenser 106; at 395, an isenthalpic expansion through valve 108, and at low side 397, evaporation in evaporator 102. Enter the condenser as a superheated vapor; give up sensible heat in region 421 until saturation is reached, then remain saturated in region 423 as the quality (fraction of the total mass in a vapor-liquid system that is in the vapor phase) decreases until all the refrigerant has condensed; then enters a sub-cooled liquid region 425.

Heretofore, it has been known to place resistance heaters in the supply (but not return) ducts of heat pump dryers simply to supplement the action of the condenser in heating and drying the air. However, one or more embodiments of the invention control the heater to achieve the desired thermodynamic state of the refrigeration cycle and then shut the heater off at the appropriate time (and/or cycle the heater). With reference to FIG. 4, $h_f$ and $h_g$ are, respectively, the saturated enthalpies of the fluid and gas. When operating at full temperature and pressure, the high side 399 (line of constant pressure) is at approximately 300 PSI, which is very close to the top 317 of the vapor dome curve. At such point, effectiveness of the heat exchanger will be lost, so it is not desirable to keep raising the high side pressure.

Furthermore, at these very high pressures, the compressor is working very hard and may be generating so much heat at the power at which it is running that the compressor temperature increases sufficiently that the thermal protection device on the compressor shuts the compressor off. In one or more embodiments, employ a sensor 110, such as a pressure transducer and/or a thermal measurement device (e.g., a thermocouple or a thermistor) and monitor the high side temperature and/or the high side pressure. When they reach a certain value which it is not desired to exceed, a controller 112 (for example, an electronic control) turns the heater off.

To re-state, a pressure transducer or a temperature sensor is located in the high side, preferably in the middle of the condenser (but preferably not at the very entrance thereof, where superheated vapor is present, and not at the very outlet thereof, where sub-cooled liquid is present). The center of the condenser is typically operating in two phase flow, and other regions may change more quickly than the center of the condenser (which tends to be quite stable and repeatable). Other high side points can be used if correlations exist or are developed, but the center of the condenser is preferred because of its stability and repeatability (that is, it moves up at the rate the cycle is moving up and not at the rate of other transients associated with the fringes of the heat exchanger). Thus, one or more embodiments involve sensing at least one of a high side temperature and a high side pressure; optionally but preferably in the middle of the condenser.

Comments will now be provided on the exemplary selection of the pressure or temperature at which the auxiliary heater is turned off. There are several factors of interest. First, the compressor pressure can reach almost 360 or 370 PSI, and the compressor will still function, before generating enough heat such that the thermal protection device shuts it off, as described above. This, however, is typically not the limiting condition; rather, the limiting condition is the oil temperature. The compressor lubricating oil begins to break down above about 220 degrees F. (temperature of the shell, oil sump, or any intermediate point in the refrigerant circuit). Initially, the oil will generate corrosive chemicals which can potentially harm the mechanism; furthermore, the lubricating properties are lost, which can ultimately cause the compressor to seize up. In one or more embodiments, limit the condenser mid temperature to no more than 190 degrees F., preferably no more than 180 degrees F., and most preferably no more than 170 degrees F. In this manner, when the heater is shut off, the compressor will stabilize at a point below where any of its shell or hardware temperatures approach the oil decomposition temperature. With regard to discharge temperature, note that point 427 will typically be about 210 degrees F. when the high side pressure is at about 320 PSI. The saturation temperature at that pressure (middle of the condenser) will be about 170 degrees F. and therefore control can be based on the mid-condenser temperature. The compressor discharge 427 is typically the hottest point in the thermodynamic cycle. The discharge is a superheated gas. The discharge gas then goes through a convective temperature change (FIG. 4 reference character 421 temperature drop) until the constant "condensing temperature" is reached. This is most accurately measured in the center of the condenser. Oil is heated by contact with the refrigerant and by contact with metal surfaces in the compressor. Generally the metal parts of the inside of the compressor run 20-30 degrees F. above the hottest point measured on the outside. The actual temperature to stay below is, in one or more embodiments, 250 degrees F. Thus, there is about a 10 degree F. margin worst case. In one or more embodiments, when the cycle is run up to this point, the maximum capacity is obtained at minimum energy, without causing any destructive condition in the compressor. Heretofore, compressors have not been operated in this region because compressor companies typically will not warrant their compressors in this region.

As noted, prior techniques using a heater do so to provide auxiliary drying capacity, not for system operating point modification, and do not carry out any sensing to turn the heater off. One or more embodiments provide a sensor 110 and a controller 112 that shut off the heater 254, 254' at a predetermined point, as well as a method including the step of shutting off the heater at a predetermined point.

Any kind of heater can be used. Currently preferred are twisted Nichrome wire (nickel-chromium high-resistance heater wire) ribbon heaters available from industrial catalogs, commonly used in hair dryers and the like.

Figure 5:
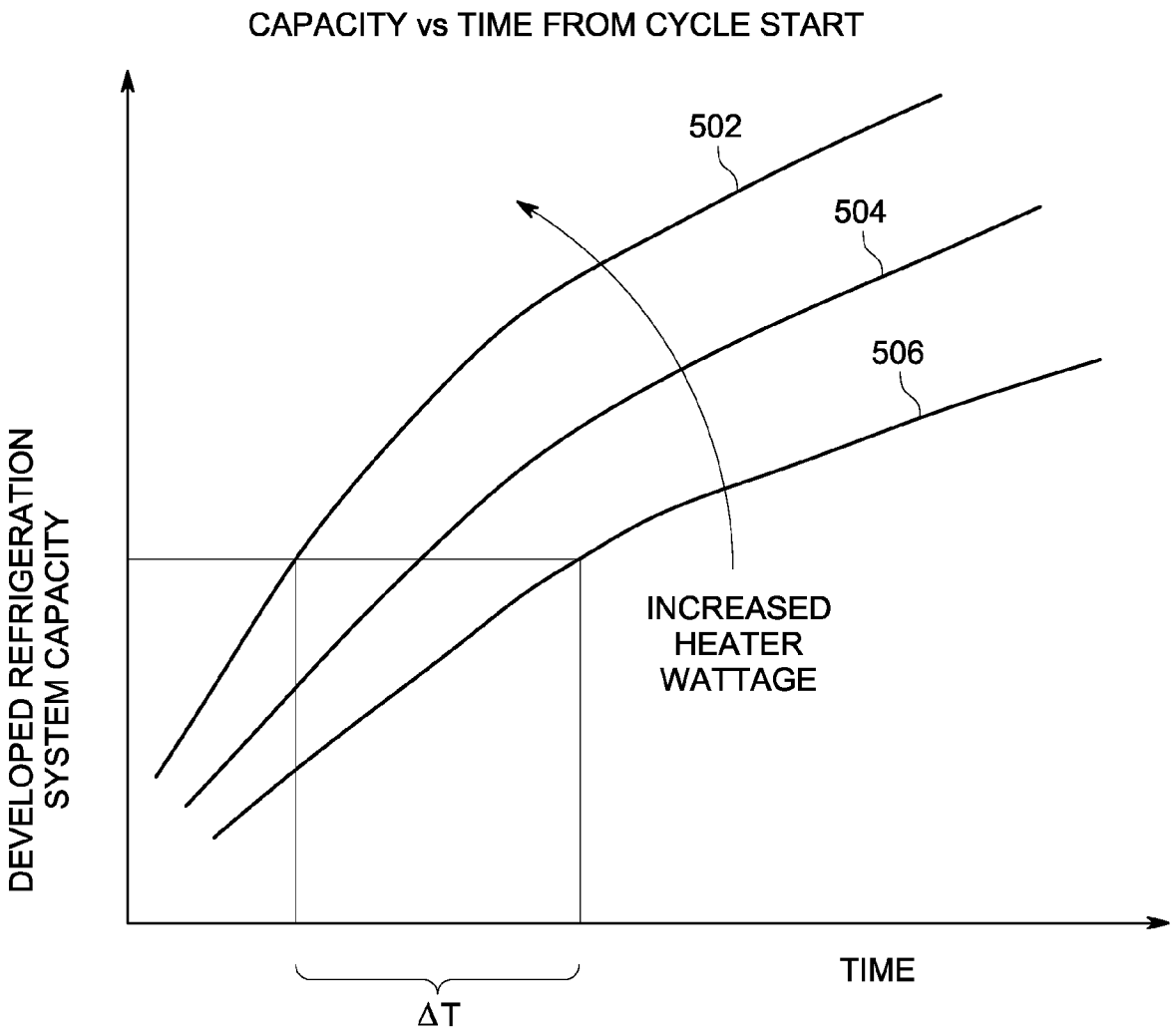
FIG. 5 presents capacity rise curves for a refrigeration system operating at elevated state points, in accordance with a non-limiting exemplary embodiment of the invention.

With the desired ending cycle for a heat pump dryer at a significant elevation above the normal air conditioning state points the transient for cycle elevation is quite long. The application of an external heater 254, 254' accelerates that transient. The observed effect is directly proportional to heater power. That is, the more power input to the auxiliary heater, the faster effective capacity and total system capacity are developed. Refer to FIG. 5, which depicts capacity rise curves of a refrigeration system operating at elevated state points with an auxiliary heater in the air circuit. The rate of capacity rise is proportional to power applied.

The faster onset of effective capacity accelerates the drying process and reduces drying time. With the heater on, the system not only moves to a higher total average pressure (and thus temperature), but also gets there significantly faster.

Thus, in one or more embodiments, application of an independent heat source to a heat pump airside circuit accelerates the progress of a refrigeration system to both effective capacity ranges and final desired state points.

Any one, some, or all of four discrete beneficial effects of the auxiliary heater can be realized in one or more embodiments. These include: (1) total amount of heat transfer attainable; (2) rate at which system can come up to full capacity; (3) cycle elevation to obtain a different state than is normally available; and (4) drying cycle acceleration.

With regard to point (2), capacity, i.e., the time it takes to get to any given capacity—it has been found that this is related to the heater and the size of the heater. In FIG. 5, time is on the lower (X) axis and capacity is on the vertical (Y) axis. Recall that with the heater elevating the system operating point, it is possible to operate at 2-3 times the rated value. The rated power of a compressor is determined by running a high back pressure compressor (air conditioning) typically at about 40 degrees F. evaporating temperature and about 131 degrees F. condensing temperature. At this rating point the rated value for an exemplary compressor is about 5000 or 7000 Btu/hr. Elevated pressures in accordance with one or more embodiments will make the compressor able to pump about 12000 or 15000 Btu/hr. This is why it is advantageous to elevate the system operating state points, to get the extra capacity. The power (wattage) of the heater also determines how fast these extra-rated values can be obtained. FIG. 5 shows the start-up curves of developed capacity versus time. With the heater in the system, it is possible to obtain more capacity faster by increasing the heater wattage.

One aspect relates to the final selection of the heater component to be installed in the drier. Thus, one or more embodiments provide a method of sizing a heater for use in a heat pump drier. The capacity ("Y") axis reads "developed refrigeration system capacity" as it does not refer to the extra heating properties of the heater itself, but rather how fast the use of the heater lets the refrigerant system generate heating and dehumidifying capacity. Prior art systems dry clothes with the electric heat as opposed to accelerating the refrigerating system coming up to full capacity. The size of the heater that is eventually chosen can help determine how fast the system achieves full capacity—optimization can be carried out between the additional wattage of the heater (and thus its power draw) and the capacity (and power draw) of the refrigeration system. There will be some optimum; if the heater is too large, while the system will rapidly come up to capacity, more total energy will be consumed than at the optimum point, due to the large heater size, whereas if the heater is too small, the system will only slowly come up to capacity, requiring more power in the refrigeration system, and again more energy will be consumed than at the optimum point. This effect can be quantified as follows. The operation of the heater involves adding power consumption for the purpose of accelerating system operation to minimize dry time. It has been determined that, in one or more embodiments, there does not appear to be a point at which the energy saved by shortening the dry time exceeds the energy expended in the longer cycle. Rather, in one or more embodiments, the total power to dry, over a practical range of heater wattages, monotonically increases with heater power rating while the efficiency of the unit monotonically decreases with heater wattage. That is to say that, in one or more embodiments, the unit never experiences a minima where the unit saves more energy by running a heater and shortening time rather than not. Thus, in one or more embodiments, the operation of a heater is a tradeoff based on desired product performance of dry time vs. total energy consumption.

In another aspect, upper line 502 represents a case where compressor power added to heater power is greater than the middle line 504. Lower line 506 could represent a case where compressor power plus heater power is less than middle line 504 but the time required to dry clothes is too long. Center line 504 represents an optimum of shortest time at minimum power. In other words, for curve 504, power is lowest for maximum acceptable time. Lower line 506 may also consume more energy, as described above, because the compressor would not be operating as efficiently.

Figure 6:
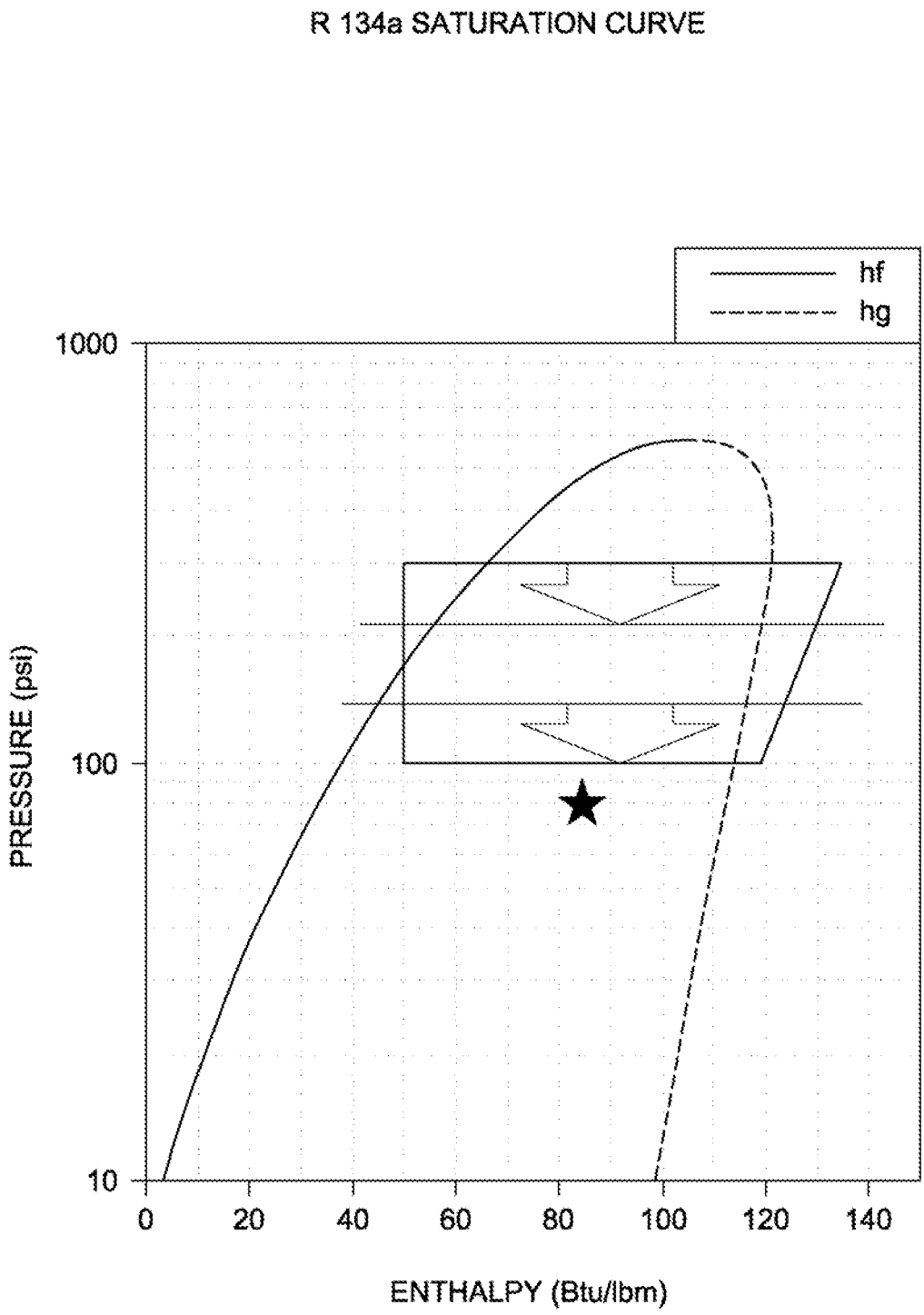
FIG. 6 is a pressure-enthalpy diagram illustrating a basic vapor compression cycle is in thermal and mass flow balance until an external source causes the balance to be upset, in accordance with a non-limiting exemplary embodiment of the invention.

As shown in FIG. 6, a basic vapor compression cycle is in thermal and mass flow balance until an external source causes the balance to be upset.

Figure 7:
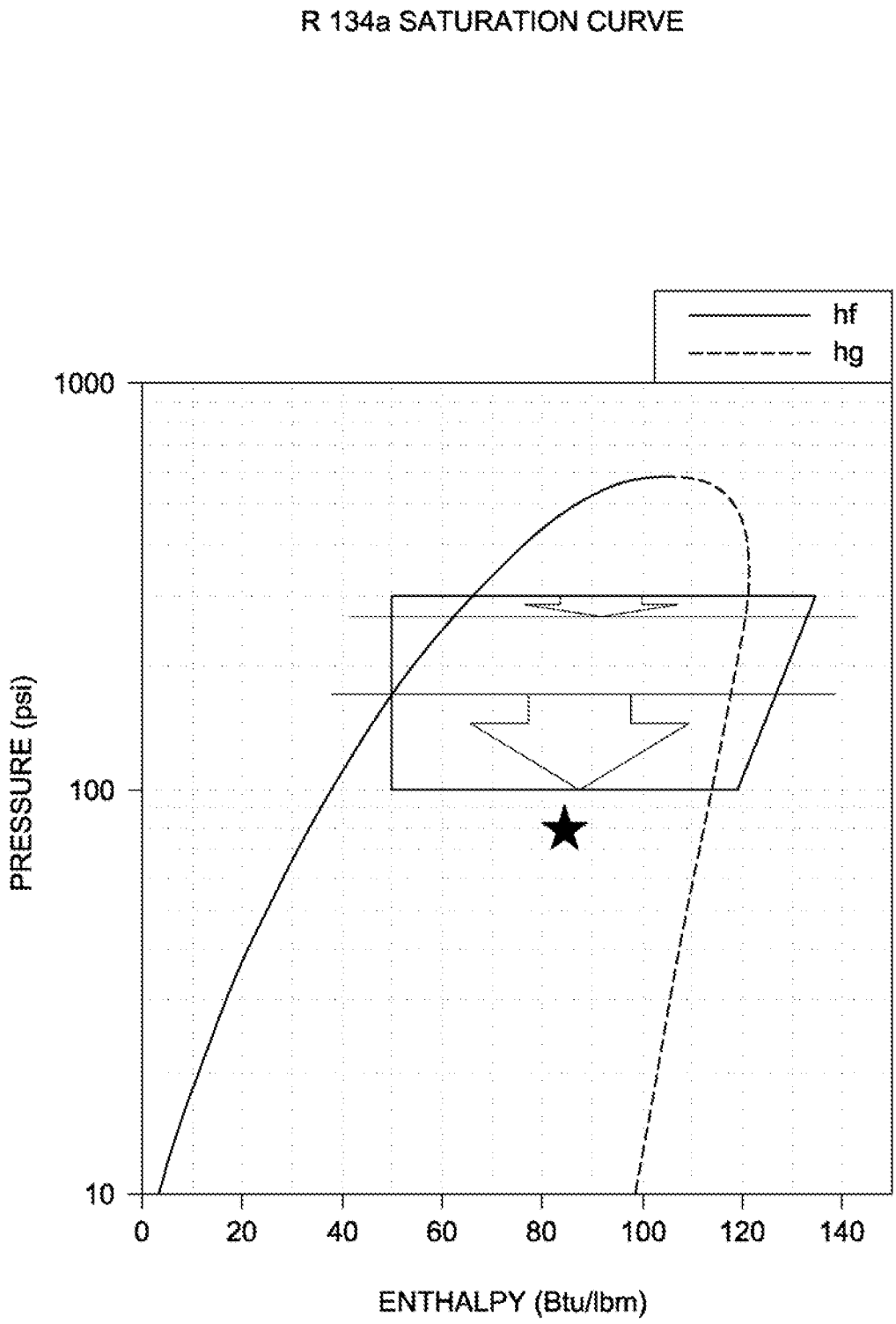
FIG. 7 is a pressure-enthalpy diagram illustrating temperature shift from auxiliary heating causes heat transfer imbalance and mass flow restriction in capillary resulting in capacity increase in evaporator, pressure elevation in condenser and mass flow imbalance, in accordance with a non-limiting exemplary embodiment of the invention.

The temperature shift from auxiliary heating causes heat transfer imbalance and mass flow restriction in the capillary (or other expansion valve) resulting in capacity increase in the evaporator and pressure elevation in the condenser. Mass flow imbalance is also a result, as seen in FIG. 7, which depicts the imbalance created by additional heat input at the evaporator by raised return temperature.

Figure 8:
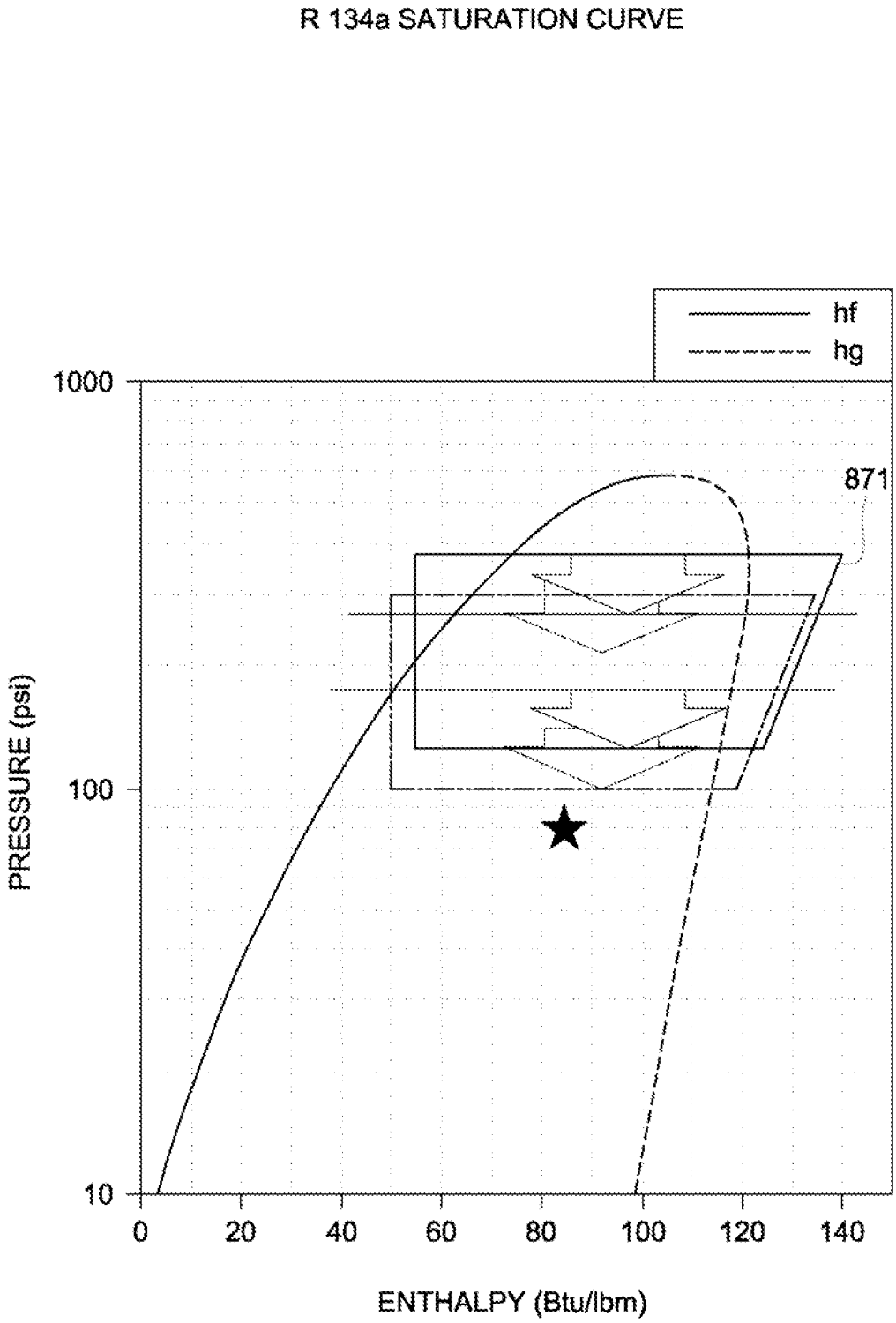
FIG. 8 is a pressure-enthalpy diagram illustrating mass flow through compressor increases due to superheating resulting in further pressure increase in condenser, the dynamic transient is completed when condenser reestablished subcooling and heat flow balance at higher pressures and the net effect is higher average heat transfer during process migration, in accordance with a non-limiting exemplary embodiment of the invention.

Mass flow through the compressor increases due to superheating resulting in further pressure increase in the condenser. The dynamic transient is completed when the condenser reestablishes sub-cooling and heat flow balance at higher pressures. The net effect is higher average heat transfer during process migration. FIG. 8 shows thermal and mass flow equilibrium reestablished at higher state points after the heat input transient.

One or more embodiments thus enable an imbalance in heat exchange by apparently larger capacity that causes more heat transfer to take place at the evaporator. The imbalance causes an apparent rise in condenser capacity in approximately equal proportion as the condensing pressure is forced upward. The combined effect is to accelerate the capacity startup transient inherent in heat pump dryers.

Experimentation has demonstrated the effect of capacity augmentation through earlier onset of humidity reduction and moisture collection in a run cycle.

Referring again to FIGS. 6-8, via the elevated cycle, it is possible to increase the capacity, inasmuch as the temperature shift from auxiliary heating causes heat transfer imbalance and mass flow restriction in the capillary (or other expansion valve) resulting in capacity increase in the evaporator and pressure elevation in the condenser. Mass flow imbalance is also a result. Furthermore, mass flow through the compressor increases due to superheating, resulting in further pressure increase in the condenser. The dynamic transient is completed when the condenser re-establishes sub-cooling and heat flow balance at higher pressures. The net effect is higher average heat transfer during process migration.

Heat is transferred by temperature difference (delta T). The high-side temperature 871 is at the top of the cycle diagram in FIG. 8. When that temperature is elevated, there is a larger delta T between the sink temperature (air to which heat is being rejected) and the actual temperature of the heat exchanger (condenser) itself. The imbalance caused by the auxiliary heater increases delta T and thus heat transfer which creates an apparent increase in capacity above that normally expected at a given condensing pressure or temperature. The effect is analogous to a shaker on a feed bowl; in effect, the heater "shakes" the refrigeration system and makes the heat move more efficiently. Again, it is to be emphasized that this is a thermodynamic effect on the heat pump cycle, not a direct heating effect on the clothes.

One or more embodiments of the invention pulse or cycle a heater in a heat pump clothes dryer to accomplish control of the heat pump's operating point. As noted above, placing a resistance heater of various wattage in the supply and/or return ducts of a heat pump dryer provides an artificial load through the drum to the evaporator by heating the supply and therefore the return air, constituting an incremental sensible load to the evaporator. This forces the system to develop higher temperatures and pressures that can cause the cycle to elevate continuously while running. In some embodiments, this can continue well past the time when desired drying performance is achieved. When the heater is turned off during a run cycle the cycle tends to stabilize without additional pressure and/or temperature rise, or even begin to decay. If the system operating points decay the original growth pattern can be repeated by simply turning the heater back on. Cycling such a heater constitutes a form of control of the capacity of the cycle and therefore the rate of drying.

As noted above, for system efficiency in a heat pump dryer, seek operating points that result in both the condenser and evaporator well above the equilibrium pressure of the system in off mode. In one or more embodiments, this elevation of the refrigeration cycle is driven by an external forcing function (i.e., heater 254, 254').

Further, in a normal refrigeration system, the source and sink of the system are normally well established and drive the migration to steady state end points by instantly supplying temperature differences. Such is not the case with a heat pump dryer, which typically behaves more like a refrigerator in startup mode where the system and the source and sink are in equilibrium with each other.

As noted above, with each subsequent recirculation of the air, a higher cycle level is reached until leakage and losses neutralize the elevating effects. Since a properly sealed and insulated system will not lose this accumulated heat, the cycle pressure elevation can continue until quite high pressure and temperature are reached. Thus, the refrigeration system moves into a regime where compressor mass flow is quite high and power consumed is quite low. However, a properly sealed and insulated system will proceed to high enough head pressures to shut off the compressor or lead to other undesirable consequences. In one or more embodiments, before this undesirable state is reached, the heater is turned off, and then the system states begin to decay and or stabilize. In one or more embodiments, control unit 112 controls the heater in a cycling or pulse mode, so that the system capacity can essentially be held constant at whatever state points are desired.

One or more embodiments thus provide capacity and state point control to prevent over-temperature or over-pressure conditions that can be harmful to system components or frustrate consumer satisfaction.

Figure 9:
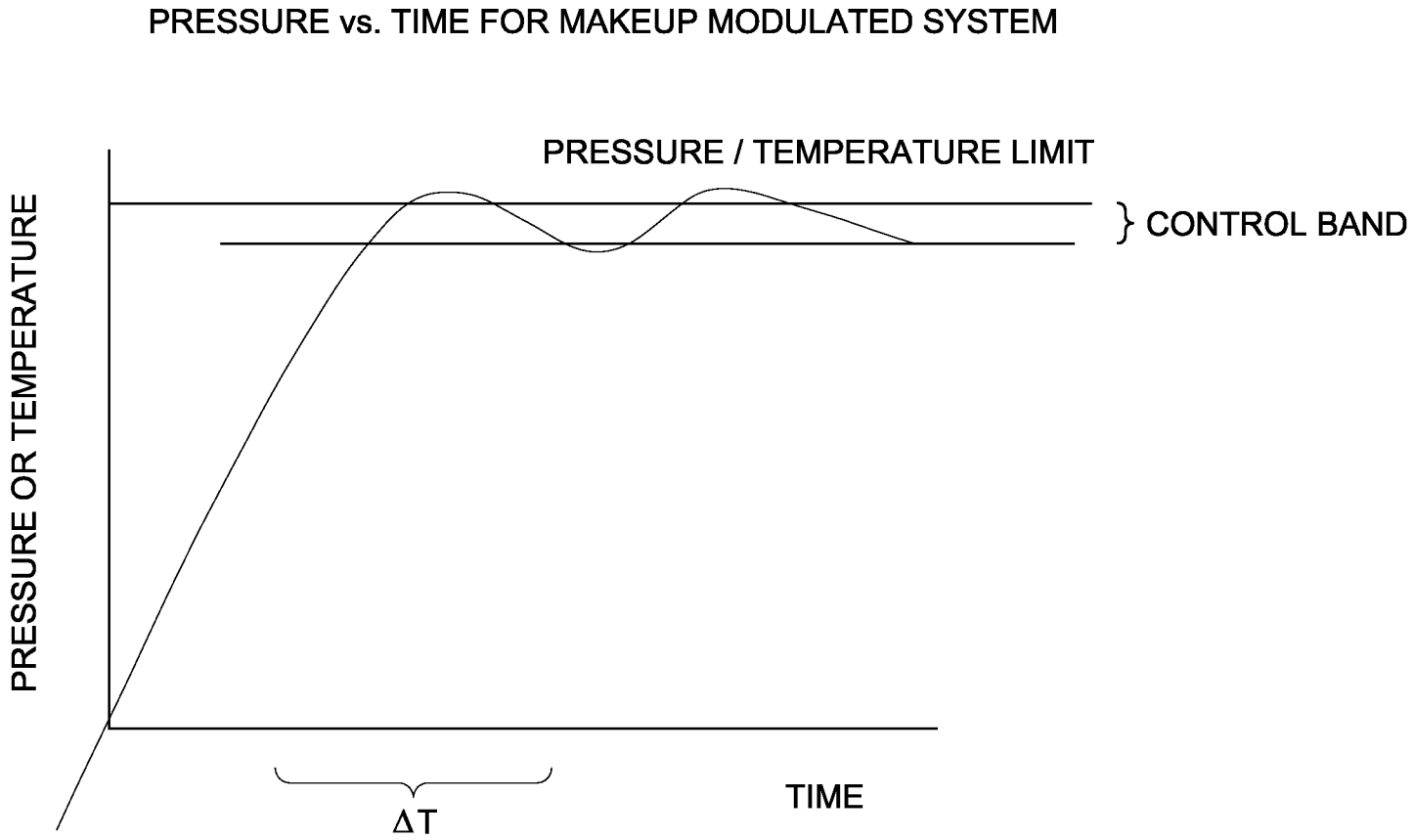
FIG. 9 presents pressure versus time for a cycle wherein an auxiliary heater is pulsed, in accordance with a non-limiting exemplary embodiment of the invention.

With reference now to FIG. 9, it is possible to accelerate the time in which the system comes up to full capacity. Once the system comes up to full capacity, then it is desired to ensure that the compressor is not overstressed. In some embodiments, simply turn off the heater when the temperature and/or pressure limits are reached (e.g., above-discussed temperature limits on compressor and its lubricant). In other cases, the heater can be cycled back on and off during the drying cycle. In the example of FIG. 9, the heater is cycled within the control band to keep the system at an elevated state.

Accordingly, some embodiments cycle the heater to keep the temperature elevated to achieve full capacity. By way of review, in one aspect, place a pressure or temperature transducer in the middle of the condenser and keep the heater on until a desired temperature or pressure is achieved. In other cases, carry this procedure out as well, but selectively turn the heater back on again if the temperature or pressure transducer indicates that the temperature or pressure has dropped off.

Determination of a control band is based on the sensitivity of the sensor, converter and activation device and the dynamic behavior of the system. These are design activities separate from the operation of the principle selection of a control point. Typically, in a control, a desired set point or comfort point is determined (e.g., 72 degrees F. for an air conditioning application). Various types of controls can be employed: electro-mechanical, electronic, hybrid electro-mechanical, and the like; all can be used to operate near the desired set or comfort point. The selection of dead bands and set points to keep the net average temperature at the desired value are within the capabilities of the skilled artisan, given the teachings herein. For example, an electromechanical control for a room may employ a 7-10 degree F. dead band whereas a 3-4 degree F. dead band might be used with an electronic control. To obtain the desired condenser mid temperature, the skilled artisan, given the teaching herein, can set a suitable control band. A thermistor, mercury contact switch, coiled bimetallic spring, or the like may be used to convert the temperature to a signal usable by a processor. The activation device may be, for example, a TRIAC, a solenoid, or the like, to activate the compressor, heater, and so on. The dynamic behavior of thermal systems may be modeled with a second order differential equation in a known manner, using inertial and damping coefficients. The goal is to cycle the auxiliary heater during operation to protect the compressor oil from overheating.

As described herein, one or more embodiments of the invention include techniques and apparatuses for airflow improvement. One or more embodiments of the invention can include the use of a drum that is divided into multiple zones or sections. For example, the drum can include an opening frontally disposed for loading and unloading the drum. The drum can also include a return section created by a perforated area on the front annular ring of the drum baffled from the rest of the drum and sealing to the door frame. Another section can include an un-perforated annular sleeve comprising the main drum. Additionally, yet another section can include the rear of the drum, perforated over greater than 50% of its surface and baffled to isolate the perforations from the rest of the case and drum, creating a supply duct to the drum.

In one or more embodiments of the invention, the relationships of these zones/sections can be interchanged as long as flow through the drum from front to back, back to front, top to bottom or bottom to top is maintained. Also, the open areas can be divided or defined by baffles that receive and channel airflow from or to a conditioning section of the air circuit within the appliance.

One or more embodiments of the invention address challenges of low airflow while drying, especially at low moisture levels. Technical aspects of the techniques and apparatus detailed herein can include high airflow, low pressure drop, easier self clearing of plastering of drying clothes, as well as providing unobstructed access to the drum (by consumers).

Accordingly, one or more embodiments of the invention include a hybrid dryer tub/drum for air flow improvement. As detailed herein, the larger areas allow reduced air velocities and pressure drops at the grills, and thereby naturally diminishing the plastering effect.

Figure 10:
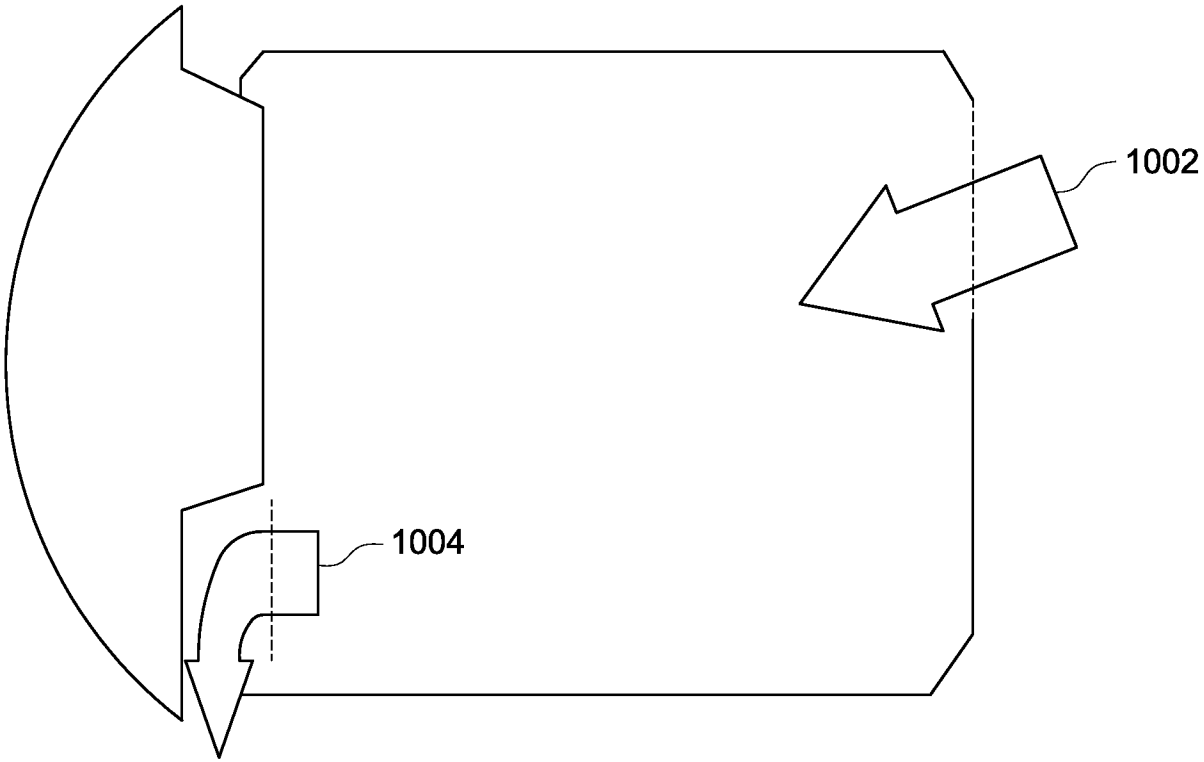
FIG. 10 (PRIOR ART)
FIG. 10 presents a conventional flow path of air in a dryer.

FIG. 10 presents a conventional flow path of air in a dryer. A conventional dryer relies on limited airflow from the rear top of the drum 1002 to the front lower drum 1004 for the most direct airflow path to exhaust. The amount of watts input to the load of an open system is the primary determinate of dry time.

With a closed system, airflow rate is presumed to be more important to dry time. Therefore, it is desirable to increase the amount of available airflow. Small, point entry and exit points create high velocities and high pressure drops in an unloaded system. But with a loaded system, a pressure drop increases very quickly until significant airflow restriction is observed.

Figure 11:
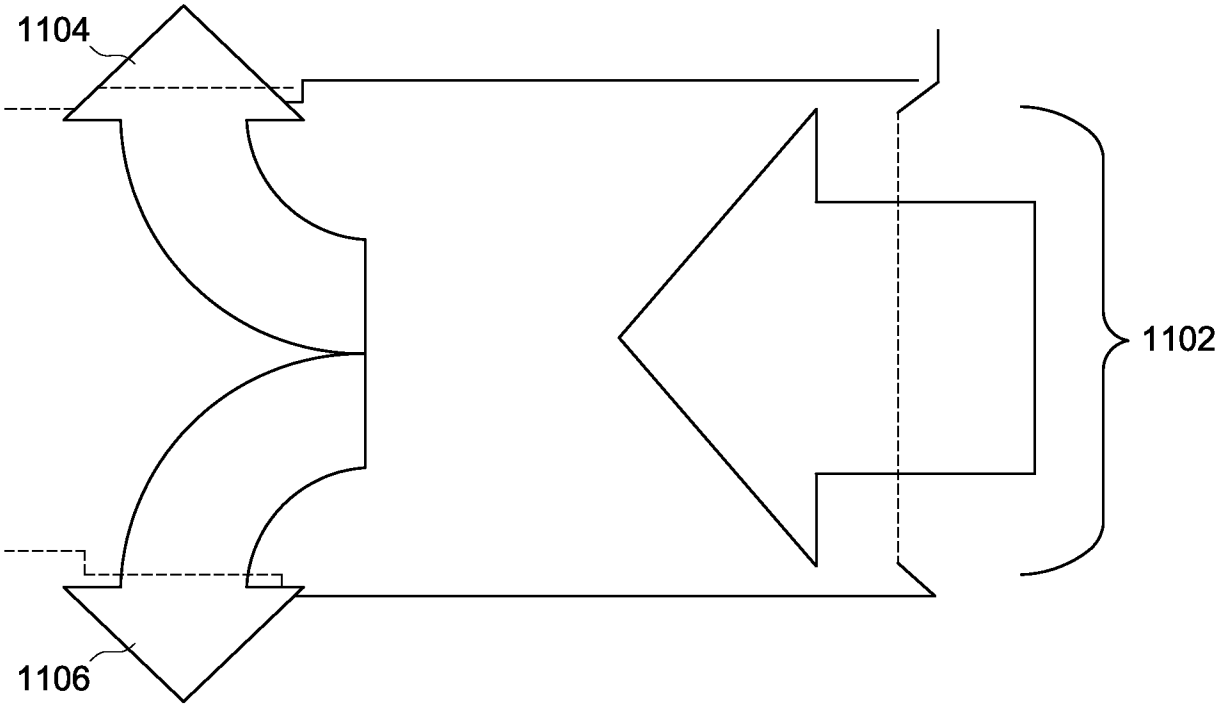
FIG. 11 presents flow path of air in a hybrid tub, in accordance with a non-limiting exemplary embodiment of the invention.

As such, in existing approaches (such as the approach depicted in FIG. 10), the air comes in only a small area on the back of the drum, whereas in one or more embodiments of the invention (for example, as depicted in FIG. 11), the entire back of the drum is perforated. Also, as illustrated in the front in FIG. 10, the very bottom of the drum in the front (of an existing approach) is a perforated grill, and that lets air into the return. In the case of the conventional dryer, the air basically gets sucked through that area and is exhausted to the outside through a blower and a discharge vent pipe.

As noted in connection with FIG. 10, a conventional dryer normally has a relatively small inlet grille 1002 in the rear and a relatively small outlet grille 1004 in the front, both of which interface with the air movement system. The pressure drops are typically high enough that air flow is limited to about 120 cubic feet per minute (CFM). In order for heat pump dryers to work effectively, higher air flow is desirable. Accordingly, reduction in pressure drop is desired.

FIG. 11 presents flow path of air in a hybrid tub, in accordance with a non-limiting exemplary embodiment of the invention. As detailed herein, one or more embodiments of the invention include a hybrid tub which increases open area for air passage through the tub allowing a lower pressure drop, lower velocities and gravity assistance to provide plastering relief.

As depicted in FIG. 11, one or more embodiments of the hybrid tub combine perforation features in a single tub construction. As shown at 1104 and 1106 in FIG. 11, in one or more embodiments of the invention, about one-third of the tub can be perforated at the front for the return, and the entire back can be perforated for the supply, as seen at 1102. Accordingly, high air flow rates can be attained, and the same advantages can be maintained for heat pump type dryers as well.

Figure 12:
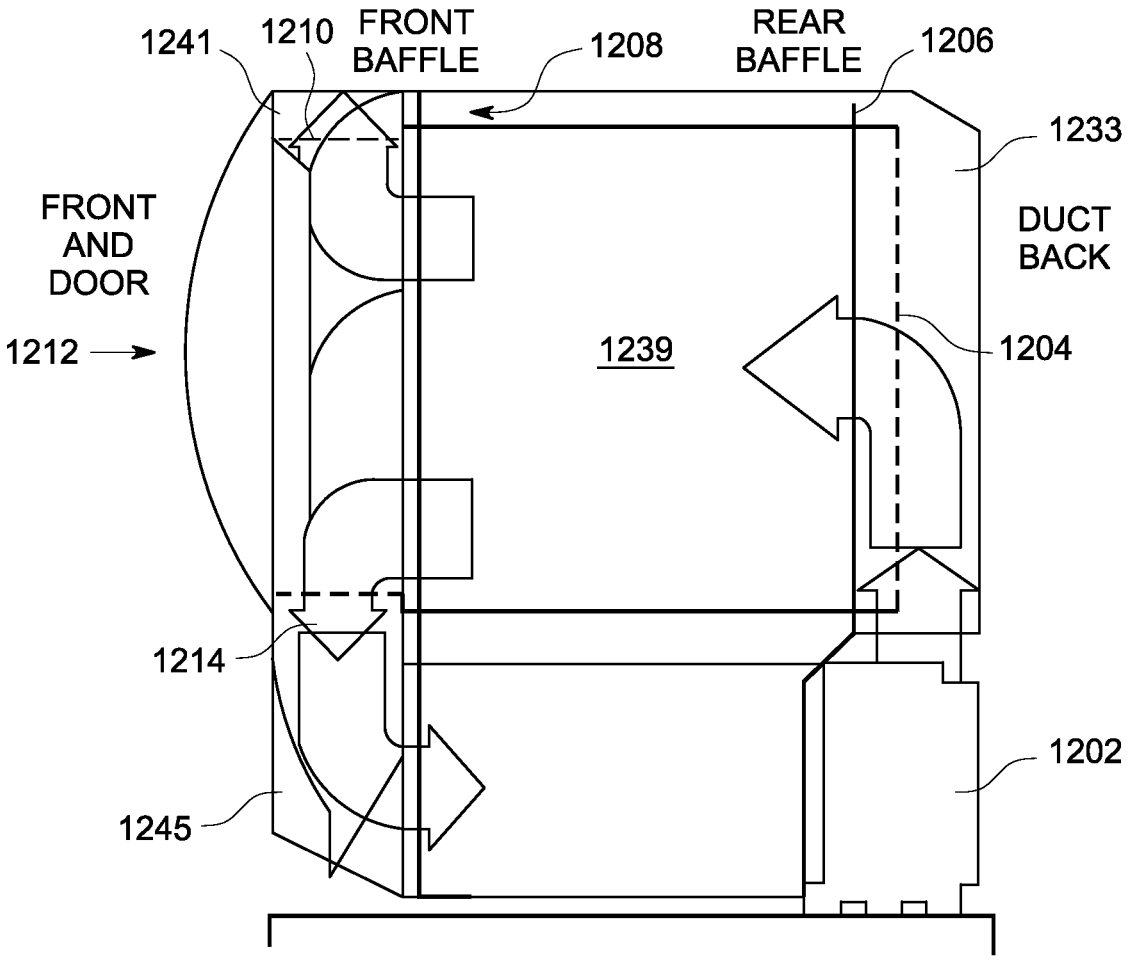
FIG. 12 presents circulation with baffled ducts and full air recirculation plan, in accordance with a non-limiting exemplary embodiment of the invention.

FIG. 12 presents circulation with baffled ducts and full air recirculation plan, in accordance with a non-limiting exemplary embodiment of the invention. FIG. 12 depicts a basic circulation path. By way of example, in one or more embodiments of the invention, as detailed herein, air flow rates of 250 CFM or more can be achieved as compared to about 120 CFM in conventional systems.

As illustrated in FIG. 12, one or more embodiments of the invention can include multiple areas of holes: on the back (1204) and on the perimeter (1210 and 1214), which are on the front, and which are perforated sections of the drum wall itself. Those perimeter areas are where the air comes out of the drum into an area of the case separated by a baffle 1208, and the front and door 1212. The air comes in the back and goes out the front on the perimeter, and there is a clear door in front of that.

As further depicted in FIG. 12, in the back, there is an inlet plenum 1233 and a baffle 1206 that can be, for example, equipped with a rotary seal so that the baffle remains stationary and the drum can rotate. Air enters from blower 1202 into the inlet plenum and flows through the perforated region 1204 and through the drum 1239, which it exits via perforated regions 1210 circumferentially continuous to 1214. A front baffle 1208 can also be equipped with a rotary seal. The holes in perforated regions 1210 and 1214 are on the circumference of the drum 1239 but they only extend over a portion of the length of the drum. Annular or peripheral plenum 1241 is provided with door 1212 in the middle thereof. The air can exit all around the periphery of the drum, into the annular plenum, and down into the return duct 1245. In one or more embodiments of the invention, for example, the perforated portions 1210 and 1214 can extend over about 20% to about 40% of the overall drum length, with about one third currently believed to be optimal.

Additionally, the loading area (for clothes) would include the top larger square section corresponding with door 1212. The lower rectangular section of FIG. 12 can include the heat exchangers, the water pump, etc. Further, the rear baffle and front baffle are baffles in the enclosure that separate the ducts from the basic cavity of the enclosure. Also, in one or more embodiments of the invention, the perforations are located directly on the drum (not on the baffles).

As described herein, the larger perforation areas of one or more embodiments of the invention allow reduced velocities and pressure drops at the grills, naturally diminishing the plastering effect. Also, such disposition of openings allows gravity both to be respected and to be used in keeping the return grill clear. Such a design allows the load curve to be shifted in favor of much higher airflow with the same power input to the blower.

A heat pump dryer does not change the fundamental causation of clothes drying. That is, drying time is inversely proportional to the rate of energy incorporated or applied to the wet clothes and the agitation that allows water vapor to be moved away from the clothes. However, because a heat pump dryer uses the heat rejection side of the vapor compression cycle to supply the heating energy, then any effect that increases the amount of heat energy supplied to the wet clothes is beneficial to reducing drying time. The following relationships are then relevant:

Increasing compressor displacement>>faster dry time

Increasing heat exchanger total area>>faster dry time

Increasing airflow rate>>faster dry time

Decreasing airflow restriction>>faster dry time

With respect to the drum component of a dryer, even when the grills only constitute 15% of the total air system pressure drop, to make it insignificant can add significantly to total system airflow which translates directly into increased heat energy to the load.

Figure 13:
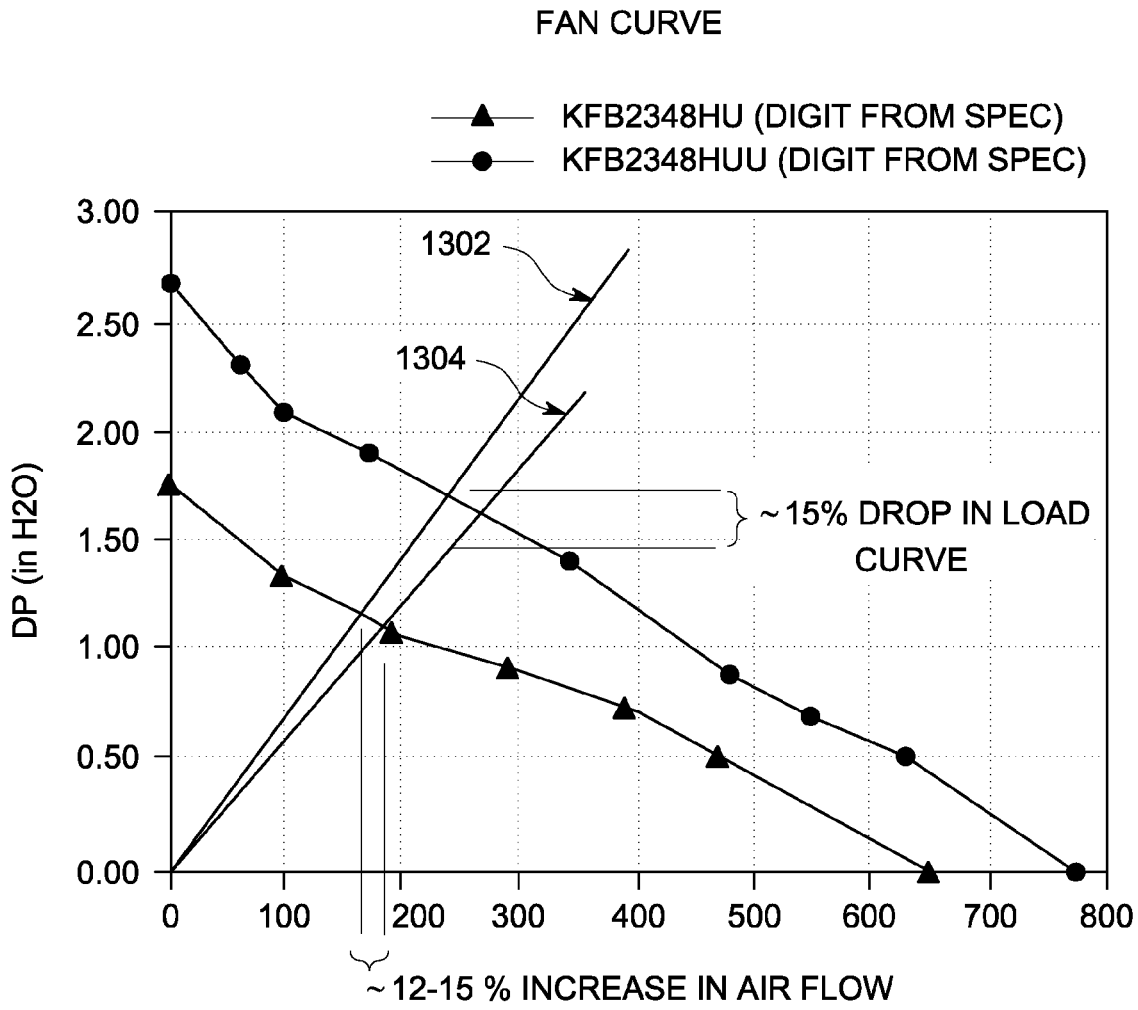
FIG. 13 presents example air system curves, in accordance with a non-limiting exemplary embodiment of the invention.

FIG. 13 presents example air system curves, in accordance with a non-limiting exemplary embodiment of the invention. The load curves represent the pressure drop versus air flow for air flowing through all the components of the air circuit. The fan curves, 1302 and 1304, represent the pressure rise possible from the fan at different air flow rates.

As depicted in FIG. 13, the difference between load curve 1302 and load curve 1304 is the fact that the grills were made so wide open that the overall pressure drop in the system drops by 15%, netting about a 12-15% increase in air flow.

One or more embodiments of the invention include obtaining one one-hundredth of the original pressure drop. Additionally, in FIG. 13, the load curves are shown as simple straight lines. Each load curve can actually made up of multiple straight lines that represent each component of the system. As such, imagine a fan of straight lines off to the right from [0,0], with each one of those lines underneath the load curve representing a different component. For example, one would represent the evaporator, one would represent the condenser, one would represent the air filters, one would represent the supply grill, one would represent the return grill, etc. The effect of making the pressure ratio go to zero (or as close to zero as possible) is to drop the respective line of the component in question to the horizontal axis. In other words, when the grill components go to zero, a 15% percent drop is achieved in the line which is in load curve 1304, which is the sum of all of the components in the system.

For instance, given a fan curve shown in FIG. 13, if the system pressure drop at airflow 150 cubic feet per minute (cfm) is about 1.2 $in_{H2O}$, and the system load curve 1302 drops 15% to load curve 1304 because grill pressure drops became negligible, then the total system airflow would go up by about 12% for this particular load-fan combination.

Capacity for the air side of a refrigerant system is a single phase problem and therefore a straight forward application of physical principles where:

$$Q_{DOT}=M_{DOT}\times C_P\times\Delta T$$

or:

$$Q_{DOT}=V_{DOT}\times\rho\times C_P\times\Delta T$$

$$Q_{DOT}=h\times A\times\Delta T$$

Where:

$$h=Nu\times k/L_C=C\times Re^n\times Pr^{0.333}$$

and:

$$Re=\rho u_\infty L_C/\mu$$

or $$Re=\rho V_{DOT}L_C/\mu A$$

so $$Q_{DOT}=C(\rho V_{DOT}L_C/\mu A)^n Pr^{0.333}A_S\Delta T$$

Where:

C and n are constants depending on the type of flow and Reynolds number;

$A_S$ is the effective surface area of the heat exchanger;

A is the open area of the duct that determines the actual velocity of airflow;

All material properties are the properties of the air; and

ΔT is the temperature difference of the coil surface to the bulk air temperature.

Therefore, any increases in airflow rate will increase air-side capacity by the $n^{th}$ power of the change in airflow rate. The understanding of the pressure drop through the grill is based in the law of conservation of energy in perfect gas flow. While no gas is truly perfect, that is, exactly follows the perfect gas law, air is close enough for engineering calculations.

Figure 14:
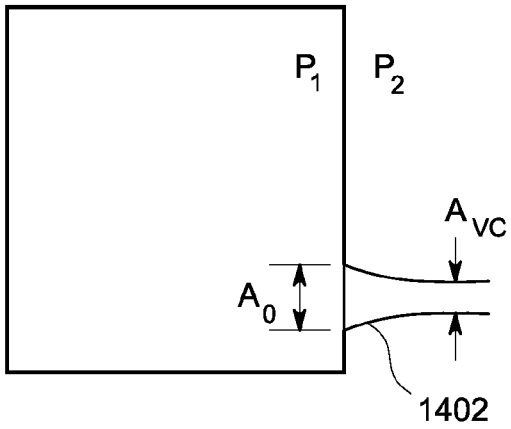
FIG. 14 presents conventional airflow out of a pressure vessel.

FIG. 14 presents conventional airflow out of a pressure vessel. As depicted, the airflow exits out of a pressure vessel through a sharp edged hole in the side of the vessel. The resulting jet of air will neck down due to roughness or friction at the orifice edges. The necking down will be dependent on both the roughness and the pressure difference. The pressure difference is the principle contributor to the flow rate from the tank, and therefore the velocity of the jet.

By way of example, consider a tank such as depicted in FIG. 14, at a pressure $P_1$ higher than the surrounding pressure $P_2$. The tank has a sharp-edged hole 1402 in its wall allowing air to escape. The hole has diameter $A_O$. If means are provided to maintain the internal pressure of the tank $P_1$, then a constant flow of air exits the tank through $A_O$ and the sharp edge results in a contraction of the flow jet to $A_{VC}$.

Writing the energy equation for the flow case can be done as follows (using the standard expression of the first law of thermodynamics for fluid flow or conservation of energy):

$$V_1^2/2g+P_1/\rho g+Z_1=V_2^2/2g+P_2/\rho g+Z_2 \quad \text{[eqn 1]}$$

But:

$V_1=0$ assumption, velocity in the drum<<<velocity through grill $Z_1=Z_2$ assumption, changes in elevation are negligible So:

$$P_1=V_2^2\rho g/2g+P_2$$

$$(P_1-P_2)=V_2^2\rho/2$$

$$\Delta P=V_2^2\rho/2 \quad \text{[eqn 2]}$$

but:

$$V=V_{DOT}/A_{VC} \quad \text{[eqn 3]}$$

And:

$$A_{VC}=A\xi \quad \text{[eqn 4]}$$

Where:

$\xi=A_{VC}/A$ or the vena contracta ratio to the cut area of a sharp edged orifice so:

$$\Delta P=(V_{DOT2})^2\rho/(2(A\xi)^2) \quad \text{[eqn 5]}$$

therefore, considering design B compared to design A or the initial design:

$$\frac{\Delta P_B}{\Delta P_A}=\frac{(V_{DOTB})^2\rho/(2(A_B\xi)^2)}{(V_{DOTA})^2\rho/(2(A_A\xi)^2)} \quad \text{[eqn 6]}$$

thus assuming:

density of air constant across designs constant;

vena contracta approximately equal across designs and flow rates;

the equation reduces to:

$$\frac{\Delta P_B}{\Delta P_A}=\frac{(V_{DOTB})^2A_A^2}{(V_{DOTA})^2A_B^2} \quad \text{[eqn 7]}$$

and when the cases of constant VDOT are considered $$\Delta P_B/\Delta P_A=(A_A^2/A_B^2)$$

$$\Delta P_B/\Delta P_A=(A_A/A_B)^2 \quad \text{[eqn 8]}$$

Thus, the ratio of pressure drops reduces to the inverse area ratio squared. When this relationship is applied to the design of grills, it can be concluded that when the area ratio squared becomes, for example, on the order of $1/50^{th}$ or even $1/100^{th}$, then the pressure drop at the component can be assumed to go to zero or fall out of the total system pressure drop.

Thus, the ratio of pressure drops reduces to the inverse area ratio squared. When this relationship is applied to the design of grills, it can be concluded that when the area ratio squared becomes on the order of $1/50^{th}$ or even $1/100^{th}$, then the pressure drop at the component can be assumed to go to zero or fall out of the total system pressure drop.

FIG. 15 presents a table illustrating relative pressure drops in heat pump dryer grills, in accordance with a non-limiting exemplary embodiment of the invention. The table illustrates findings in the case of an example hybrid drum. In this example, the pressure drop through the grill is 0.0018 or 2/10,000 the pressure drop of the original grill. While this is merely an example, it suffices to make the return grill vanish in the pressure drop of the entire air circuit.

Additionally, in one or more embodiments of the invention, because so much area is provided, plaquing, or the layering of clothes over the return grill as the clothes near drying, can be substantially reduced. Because so much flow goes through other areas, the dryer is unable to maintain suction of a piece of cloth over the grill, thus allowing the cloth to be readily removed from the grill by gravity or the agitation of other pieces of cloth.

With respect to the size of the holes or perforations, generally in existing approaches, the holes are approximately ⅜-inch by ⅜-inch square holes, or they can be as large as ½-inch by ½-inch. In one or more embodiments of the invention, the perforations can be, for example, ¼-inch by ¼-inch (so as to not, for example, catch buttons). Additionally, as depicted in FIG. 15, in the very last column (Hybrid Return Grill Special), the accumulation of holes is made by 72 inches of perimeter, 4 inches of width, 432 square inches, with a perforation ratio—in other words, an opening ratio to metal ratio—of 0.6. In this noted example, 259.2 inches squared was used, and the result is shown in the right-most circle on the table, namely, that it is 0.00018 (18 ten-thousandths) of the original pressure drop that the original grill would have had, which is shown in column 2 of the table. The Basic Return Grill column shows the number of holes to be 120, a diameter of 0.25×0.375, for 11.25 square inches. Accordingly, when the last column is compared to the Basic Return Grill column, the pressure difference, the pressure ratio or pressure drop in the modified or hybrid condition compared to the original condition is 0.001884. Thus, that illustrates how the pressure is modified by making a continuous ring of holes on the perimeter front of the tub and gathering the air there.

The larger circle (on the table of FIG. 15) that is circling two numbers (three spoke grill, and three-spoke grill with insert) illustrates the situation if the same kind of insert is done on the rear grill that is being done on the hybrid grill, which results in a ratio of 0.015 (it is 0.09 with the standard three-spoke grill). Accordingly, if one takes the first column, basic supply grill, and goes with a three-spoke grill, it is only a ratio of 0.1, or a tenth the pressure drop of the original basic supply grill. If the same is done with an insert similar to what is being done with the hybrid, it would be a ratio of 0.015, or one one-hundredth of the pressure drop. As such, these two actions make the supply and return grill vanish from the pressure drop of the load curve, thus reducing the overall load curve by the 15%.

Further, for purposes of completeness, supply grill "full" indicates that the holes are all punched for the full indentation array (design for a grill).

FIG. 16 presents a chart illustrating relative pressure drops in heat pump dryer grills, in accordance with a non-limiting exemplary embodiment of the invention. This table demonstrates the techniques described herein applied to the supply and return grills of the drum. FIG. 16 is a simplified version of FIG. 15 for the specific case of the end design range for supply and return grill using the methodology developed above.

FIG. 17 presents an example return duct, in accordance with a non-limiting exemplary embodiment of the invention. By way of illustration, FIG. 17 depicts a baffle 1702 with a modified flange, a return duct 1704 with a modified rib on the front, a gasket 1706 (which is sandwiched between the baffle and top enclosure parts) and a top enclosure 1708.

Figure 18:
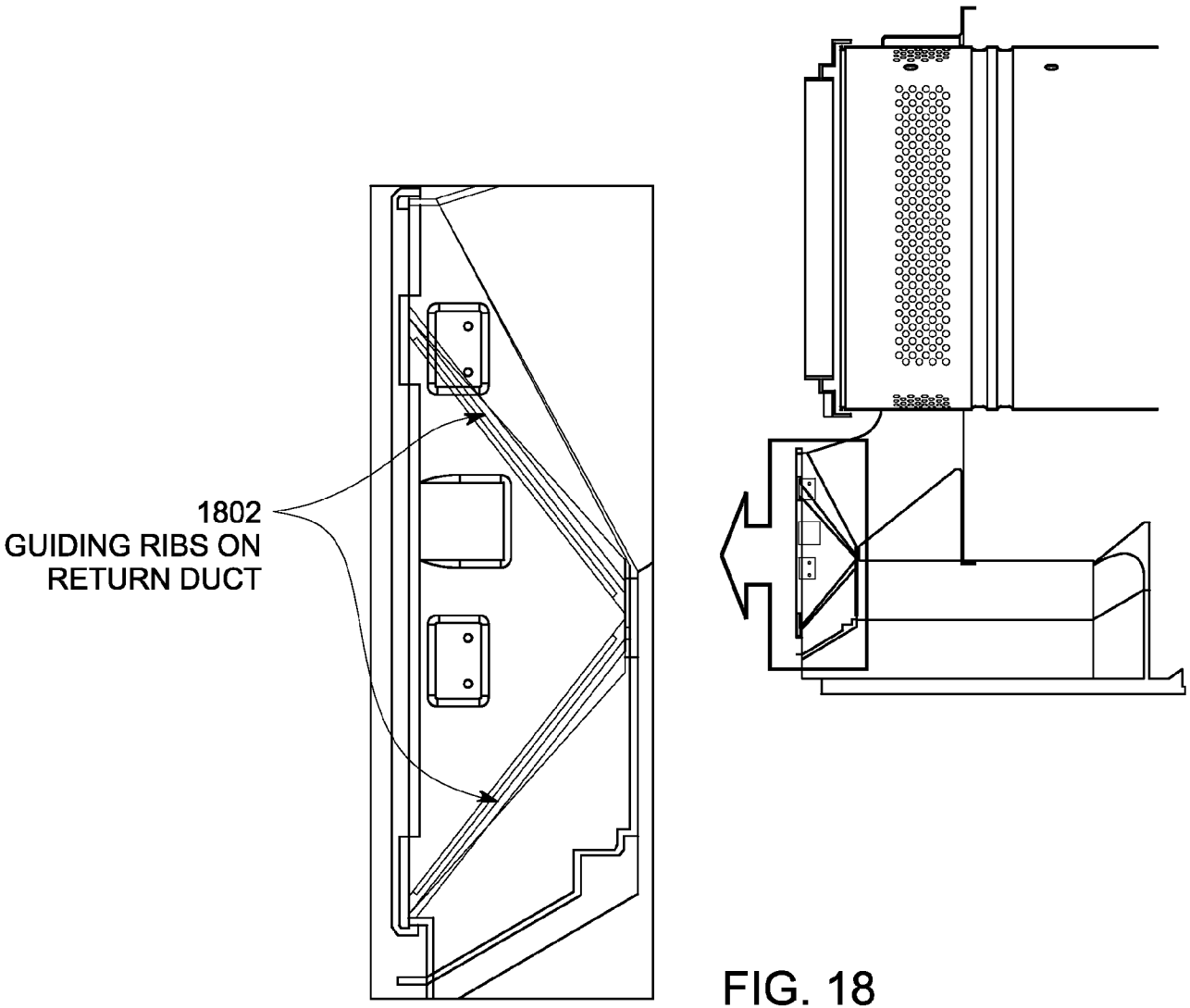
FIG. 18 presents an example return duct, in accordance with a non-limiting exemplary embodiment of the invention.

FIG. 18 presents an example return duct, in accordance with a non-limiting exemplary embodiment of the invention. By way of illustration, FIG. 18 depicts guiding ribs 1802 on the return duct. In one or more embodiments of the invention, the guiding ribs can be of 0.500" in width and part thickness.

Figure 19:
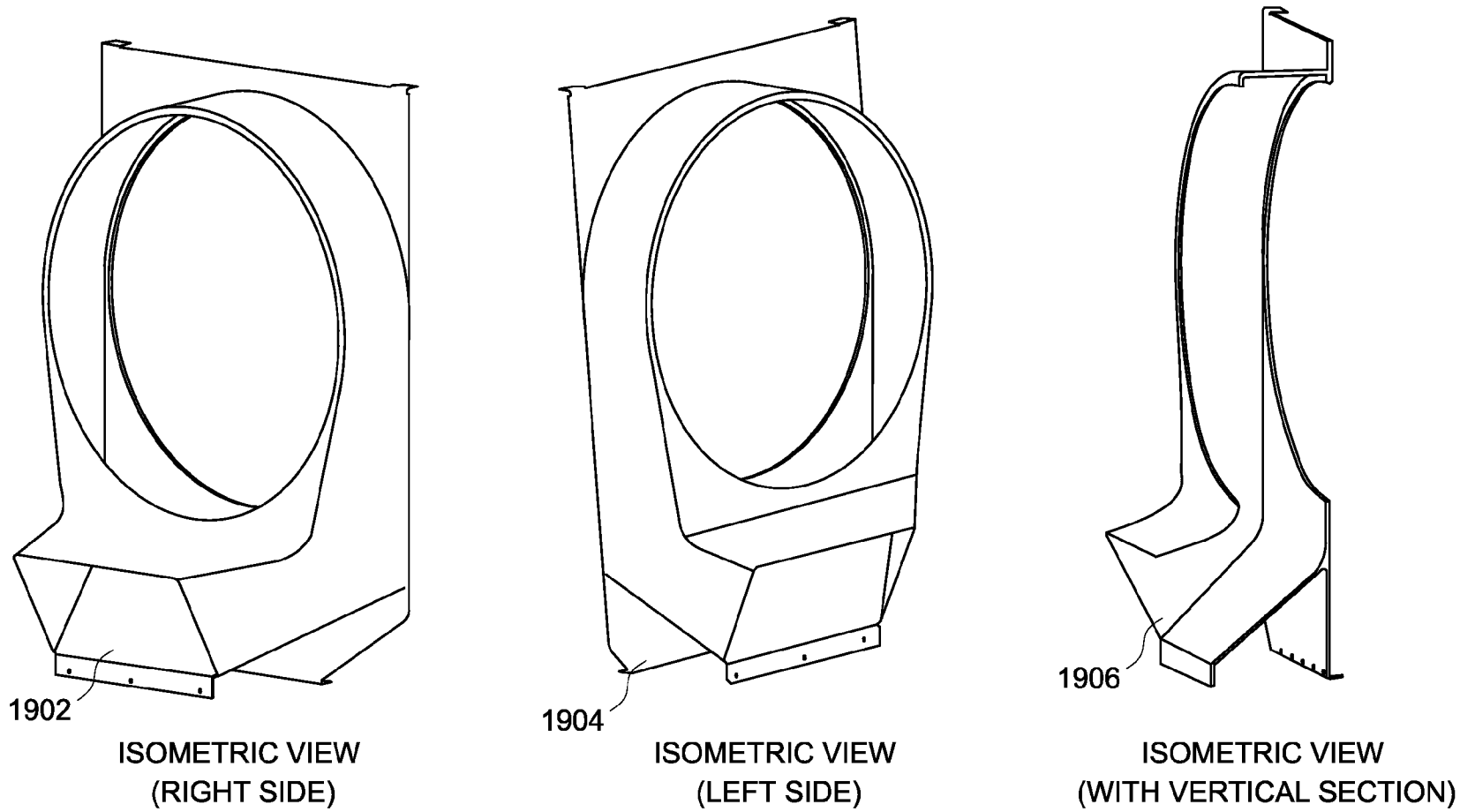
FIG. 19 presents multiple views of an example baffle, in accordance with a non-limiting exemplary embodiment of the invention.
Figure 20:
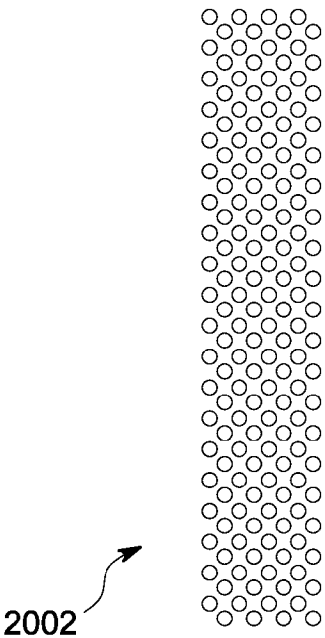
FIG. 20 presents multiple views of example perforations, in accordance with a non-limiting exemplary embodiment of the invention.

FIG. 19 presents multiple views of an example baffle, in accordance with a non-limiting exemplary embodiment of the invention. By way of illustration, FIG. 19 depicts an isometric view (right side) 1902 of the baffle, an isometric view (left side) 1904 of the baffle, and an isometric view (with vertical section) 1906 of the baffle. In one or more embodiments of the invention, a baffle can have a thickness of 0.025" to 0.100" and can be made of, for example, plastic. Also, in one or more embodiments of the invention, a baffle can include a thickness of selected material sufficient to produce an impermeable surface or membrane to prevent air migration or escape from desired circulation path FIG. 20 presents multiple views of example perforations, in accordance with a non-limiting exemplary embodiment of the invention. By way of illustration, FIG. 20 depicts an isometric view (right side) 2002 of perforations (a "flat pattern").

Figure 21:
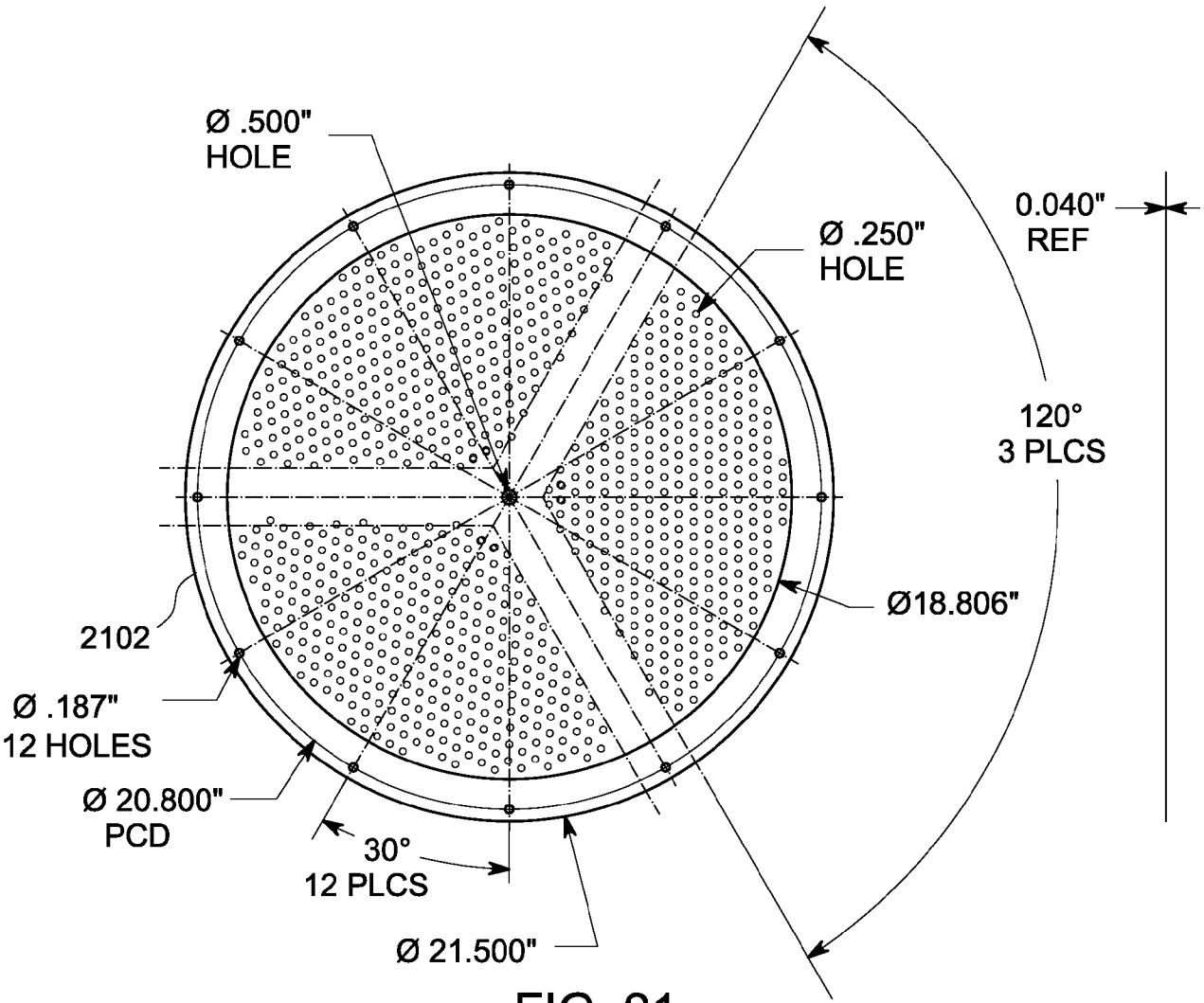
FIG. 21 presents an example drum back, in accordance with a non-limiting exemplary embodiment of the invention.
Figure 22:
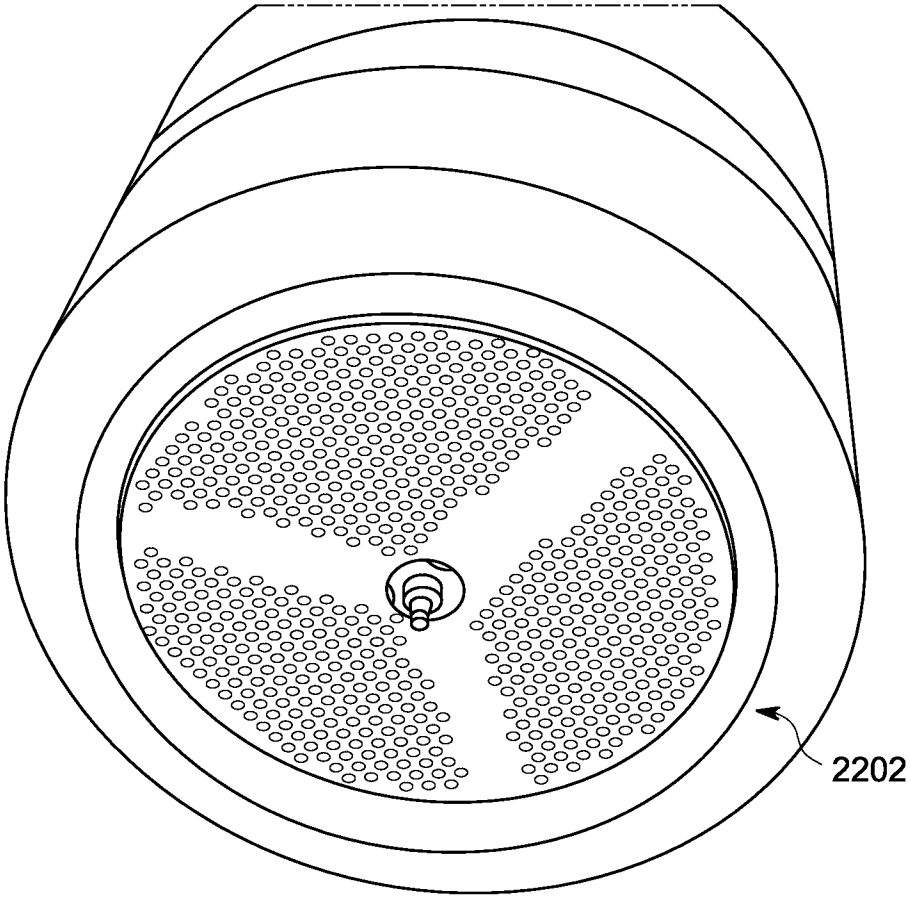
FIG. 22 presents an example drum back, in accordance with a non-limiting exemplary embodiment of the invention.
Figure 23:
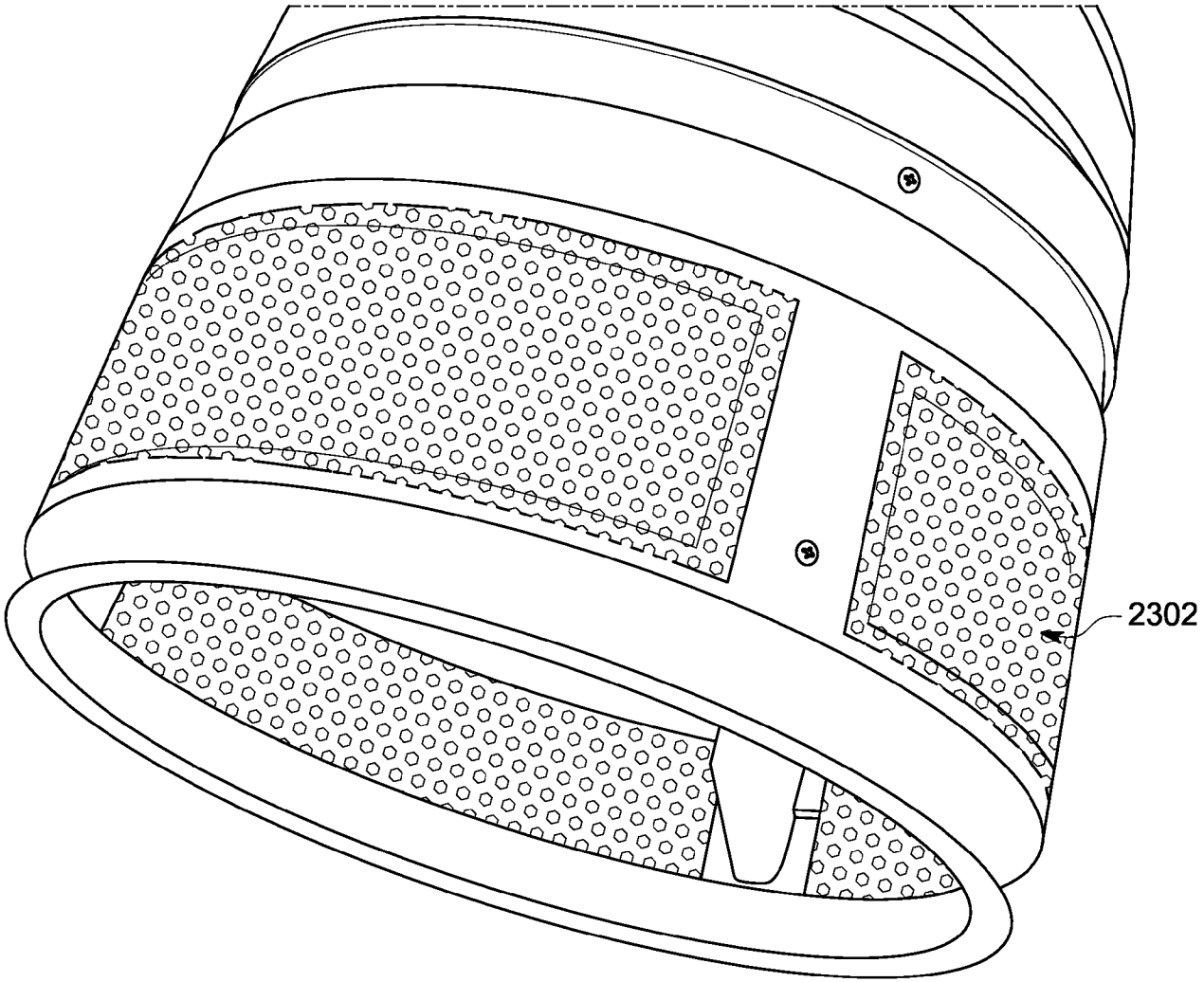
FIG. 23 presents an example front annular ring of the drum, in accordance with a non-limiting exemplary embodiment of the invention.

FIG. 21 presents an example drum back 2102, in accordance with a non-limiting exemplary embodiment of the invention. FIG. 22 also presents an example drum back 2202, in accordance with a non-limiting exemplary embodiment of the invention. Additionally, FIG. 23 presents an example front annular ring of the drum 2302, in accordance with a non-limiting exemplary embodiment of the invention.

FIG. 24 presents a chart illustration of perforation area calculation by a spreadsheet using simple area formulas, in accordance with a non-limiting exemplary embodiment of the invention.

One advantage that may be realized in the practice of some embodiments of the described systems and techniques is implementing the free flowing of air through a drum without the need of a double tub construction.

Figure 25:
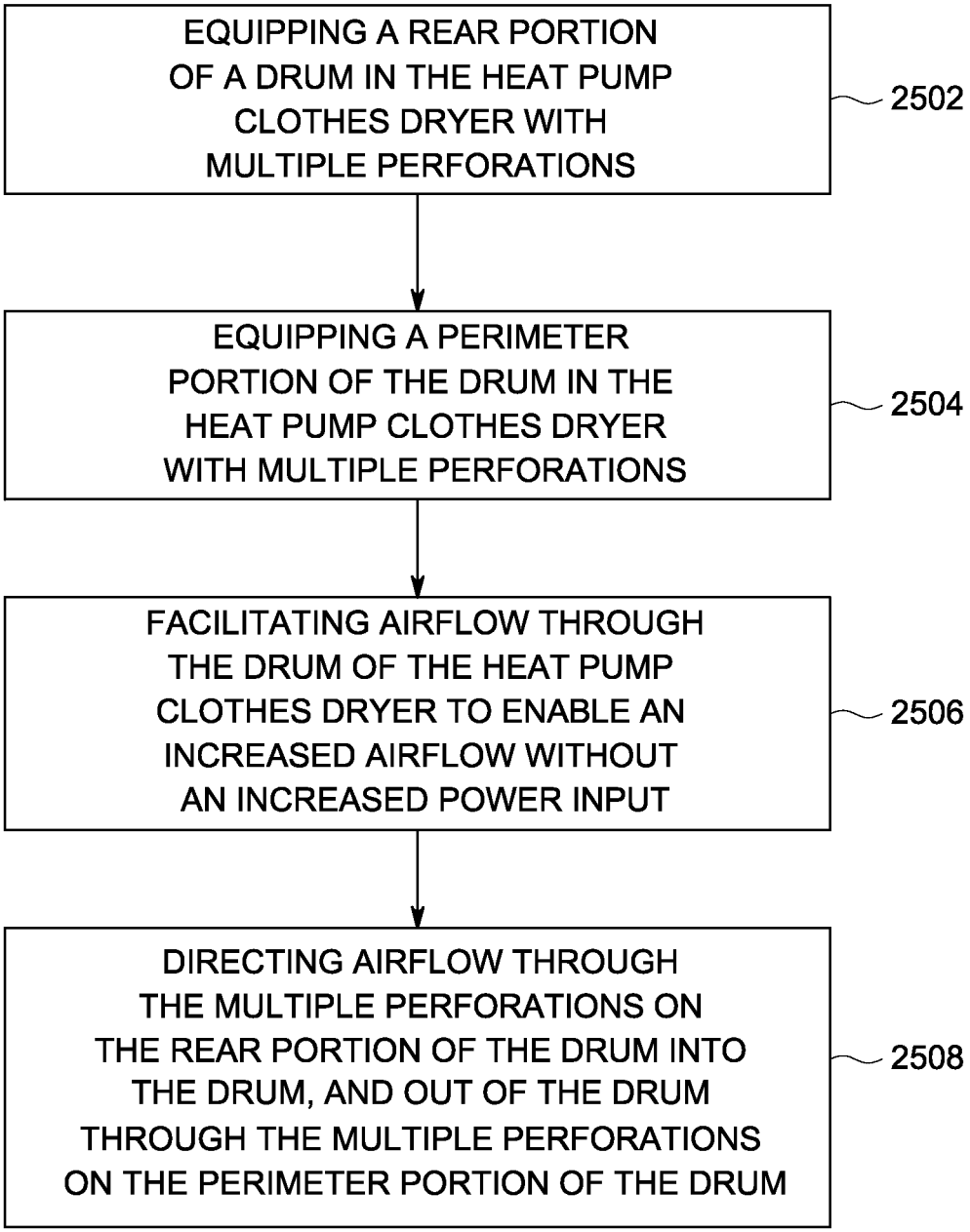
FIG. 25 is a flow chart of a method for airflow improvement, in accordance with a non-limiting exemplary embodiment of the invention.

Reference should now be had to the flow chart of FIG. 25. FIG. 25 is a flow chart of a method for airflow improvement, in accordance with a non-limiting exemplary embodiment of the invention. Step 2502 includes equipping a rear portion of a drum in the heat pump clothes dryer with multiple perforations. Equipping a rear portion of a drum in the heat pump clothes dryer with multiple perforations can include equipping greater than fifty-percent of the rear portion of the drum in the heat pump clothes dryer with perforations. Also, in one or more embodiments of the invention, equipping a rear portion of a drum in the heat pump clothes dryer with multiple perforations comprises equipping an entire rear surface of the drum with perforations.

Step 2504 includes equipping a perimeter portion of the drum in the heat pump clothes dryer with multiple perforations. Equipping a perimeter portion of the drum in the heat pump clothes dryer with multiple perforations can include equipping a circumference of the perimeter portion of the drum, extending over a portion of a length of the drum, with perforations. In one or more embodiments of the invention, the portion of the length of the drum can include from about 20% to about 40% of an overall drum length.

Step 2506 includes facilitating airflow through the drum of the heat pump clothes dryer to enable an increased airflow without an increased power input. Step 2508 includes directing airflow through the multiple perforations on the rear portion of the drum into the drum, and out of the drum through the multiple perforations on the perimeter portion of the drum. Directing airflow through the multiple perforations on the rear portion of the drum into the drum, and out of the drum through the multiple perforations on the perimeter portion of the drum can include facilitating air to exit around an entire periphery of the drum, into an annular plenum, and then into a return duct.

The techniques depicted in FIG. 25 can also include baffling the perforated perimeter portion of the drum from remaining portions of the drum and sealing to a door frame. One or more embodiments of the invention can additionally include baffling the perforated rear portion of the drum to isolate the multiple perforations from other portions of the drum and case, creating a supply duct to the drum. Further, the techniques depicted in FIG. 25 can include leaving a portion of the drum un-perforated, wherein the un-perforated portion comprises a main drum.

Further, given the discussion thus far, it will be appreciated that, in general terms, an exemplary apparatus, according to another aspect of the invention, includes a mechanical refrigeration cycle arrangement in turn having a working fluid and an evaporator 102, condenser 106, compressor 104, and an expansion device 108, cooperatively interconnected and containing the working fluid. The apparatus also includes a drum 258 to receive clothes to be dried, a duct and fan arrangement (e.g., 252, 256, 260, 262) configured to pass air over the condenser 106 and through the drum 258, and a sensor (e.g., 110) located to sense at least one parameter. The at least one parameter includes temperature of the working fluid, pressure of the working fluid, and power consumption of the compressor. Also included is a controller 112 coupled to the sensor and the compressor. With respect to the drum to receive clothes to be dried, a rear portion of the drum is equipped with multiple perforations, and a perimeter portion of the drum is equipped with multiple perforations. Additionally, the duct and fan arrangement is configured to pass air over said condenser and through said drum, wherein the duct and fan arrangement is further configured to facilitate airflow through the perforations on the rear portion of the drum into the drum, and out of the drum through the perforations on the perimeter portion of the drum to enable an increased airflow without an increased power input.

Figure 26:
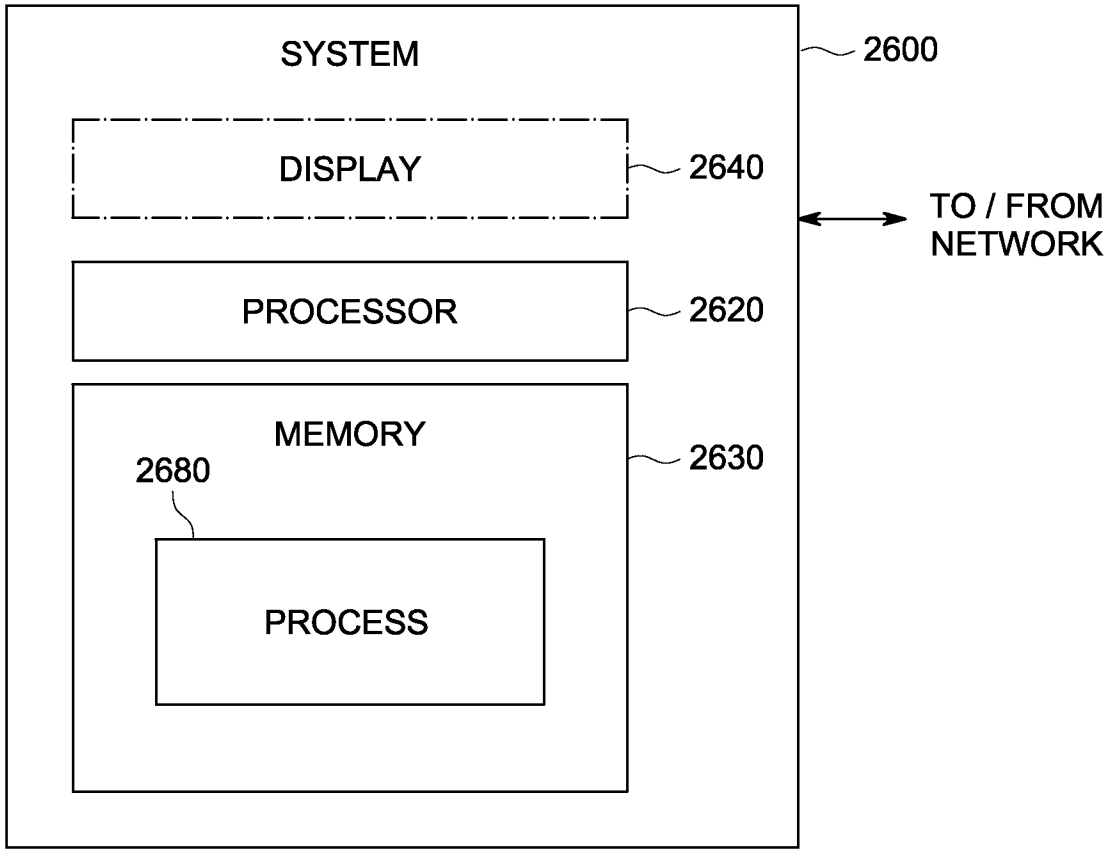
FIG. 26 is a block diagram of an exemplary computer system useful in connection with one or more embodiments of the invention.

Aspects of the invention (for example, controller 112 or a workstation or other computer system to carry out design methodologies) can employ hardware and/or hardware and software aspects. Software includes but is not limited to firmware, resident software, microcode, etc. FIG. 26 is a block diagram of a system 2600 that can implement part or all of one or more aspects or processes of the invention. As shown in FIG. 26, memory 2630 configures the processor 2620 to implement one or more aspects of the methods, steps, and functions disclosed herein (collectively, shown as process 2680 in FIG. 26). Different method steps could theoretically be performed by different processors. The memory 2630 could be distributed or local and the processor 2620 could be distributed or singular. The memory 2630 could be implemented as an electrical, magnetic or optical memory, or any combination of these or other types of storage devices. It should be noted that if distributed processors are employed (for example, in a design process), each distributed processor that makes up processor 2620 generally contains its own addressable memory space. It should also be noted that some or all of computer system 2600 can be incorporated into an application-specific or general-use integrated circuit. For example, one or more method steps (e.g., involving controller 112) could be implemented in hardware in an ASIC rather than using firmware. Display 2640 is representative of a variety of possible input/output devices. Examples of suitable controllers have been set forth above. Additionally, examples of controllers for heater control above can also be used for cycle completion. An example can include a micro with ROM storage of constants and formulae which perform the necessary calculations and comparisons to make the appropriate decisions regarding cycle termination.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a processor or other computer system, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer to read instructions and data, such as magnetic variations on a magnetic medium or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Thus, elements of one or more embodiments of the invention, such as, for example, the controller 112, can make use of computer technology with appropriate instructions to implement method steps described herein.

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components. In some cases, an interface with sensor 110 is provided.

It should also be noted that the exemplary temperature and pressure values herein have been developed for Refrigerant R-134a; however, the invention is not limited to use with any particular refrigerant. For example, in some instances Refrigerant R-410A could be used. The skilled artisan will be able to determine optimal values of various parameters for other refrigerants, given the teachings herein.

Thus, while there have shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method comprising:

in a heat pump clothes dryer operating on a mechanical refrigeration cycle, equipping a rear portion of a drum in the heat pump clothes dryer with multiple perforations;

equipping a perimeter portion of a front of the drum in the heat pump clothes dryer with multiple perforations; and facilitating airflow through the drum of the heat pump clothes dryer to enable an increased airflow without an increased power input; wherein facilitating airflow comprises directing inlet airflow through the multiple perforations on the rear portion of the drum into the drum and directing outlet airflow out of the drum through the multiple perforations on the perimeter portion of the front of the drum.

2. The method of claim 1, wherein equipping a rear portion of a drum in the heat pump clothes dryer with multiple perforations comprises equipping greater than fifty-percent of the rear portion of the drum in the heat pump clothes dryer with perforations.

3. The method of claim 1, wherein equipping a perimeter portion of the front of the drum in the heat pump clothes dryer with multiple perforations comprises equipping a circumference of the perimeter portion of the drum, extending over a portion of a length of the drum, with perforations.

4. The method of claim 1, wherein directing inlet airflow through the multiple perforations on the rear portion of the drum into the drum, and directing outlet airflow out of the drum through the multiple perforations on the perimeter portion of the front of the drum comprises facilitating air to exit around an entire periphery of the drum, into an annular plenum, and then into a return duct.

5. The method of claim 1, further comprising baffling the perforated perimeter portion of the front of the drum from remaining portions of the drum and sealing to a door frame.

6. The method of claim 1, further comprising baffling the perforated rear portion of the drum to isolate the multiple perforations from other portions of the drum and a case of the hear pump clothes dryer, creating a supply duct to the drum.

7. An apparatus comprising:

a mechanical refrigeration cycle arrangement in turn comprising:

a working fluid; and an evaporator, a condenser, a compressor, and an expansion device, cooperatively interconnected and containing said working fluid;

a sensor located to sense at least one parameter;

a controller coupled to said sensor and said compressor;

a drum to receive clothes to be dried, wherein:

a rear portion of the drum is equipped with multiple perforations, and a perimeter portion of a front of the drum is equipped with multiple perforations; and a duct and fan arrangement configured to pass air over said condenser and through said drum, wherein the duct and fan arrangement is further configured to:

facilitate airflow by directing inlet airflow through the multiple perforations on the rear portion of the drum into the drum and directing outlet airflow out of the drum through the multiple perforations on the perimeter portion of the front of the drum to enable an increased airflow without an increased power input.

8. The apparatus of claim 7, wherein the perimeter portion of the front of the drum equipped with multiple perforations comprises an air-return section created by a perforated area on a front annular ring of the drum that is baffled by a baffle from remaining portions of the drum and sealing to a door frame.

9. The apparatus of claim 8, wherein the baffle comprises a thickness of selected material sufficient to produce an impermeable surface or membrane to prevent air migration or escape from desired circulation path.

10. The apparatus of claim 7, wherein the perimeter portion of the front of the drum equipped with multiple perforations comprises a circumference of the perimeter portion of the drum, extending over a portion of a length of the drum, equipped with perforations, wherein the portion of the length of the drum comprises from about 20% to about 40% of an overall drum length.

11. The apparatus of claim 7, wherein the drum further comprises an un-perforated annular sleeve, wherein the un-perforated annular sleeve comprises a main drum.

12. The apparatus of claim 7, wherein the rear portion of the drum is equipped with perforations over greater than fifty-percent of the rear portion surface.

13. The apparatus of claim 7, wherein the rear portion of the drum is equipped with perforations over an entire rear surface of the drum.

14. The apparatus of claim 7, wherein the rear portion of the drum is baffled by a baffle to isolate the multiple perforations from other portions of the drum and a case of the heat pump clothes dryer, creating a supply duct to the drum.

15. The apparatus of claim 14, wherein the baffle comprises a material sufficient to produce an impermeable surface or membrane to prevent air migration or escape from desired circulation path.

16. The apparatus of claim 7, wherein the drum further comprises an opening frontally disposed for loading and unloading the drum.

17. An apparatus comprising:

a drum to receive clothes to be dried, wherein:

a rear portion of the drum is equipped with multiple perforations, and a perimeter portion of a front of the drum is equipped with multiple perforations; and a duct and fan arrangement configured to pass air over said a condenser and through said drum, wherein the duct and fan arrangement is further configured to:

facilitate airflow by directing inlet airflow through the multiple perforations on the rear portion of the drum into the drum and directing outlet airflow out of the drum through the multiple perforations on the perimeter portion of the front of the drum to enable an increased airflow without an increased power input.

18. The apparatus of claim 17, wherein the perimeter portion of the front of the drum equipped with multiple perforations comprises a circumference of the perimeter portion of the drum, extending over a portion of a length of the drum, equipped with perforations, wherein the portion of the length of the drum comprises from about 20% to about 40% of an overall drum length.

19. The apparatus of claim 17, wherein the rear portion of the drum is equipped with perforations over greater than fifty-percent of the rear portion surface.

20. The apparatus of claim 17, wherein the drum further comprises an un-perforated annular sleeve, wherein the un-perforated annular sleeve comprises a main drum.

21. The apparatus of claim 17, wherein the perimeter portion of the front of the drum equipped with multiple perforations comprises an air-return section created by a perforated area on a front annular ring of the drum that is baffled from remaining portions of the drum and sealing to a door frame.

22. The apparatus of claim 17, wherein the rear portion of the drum is baffled to isolate the multiple perforations from other portions of the drum and a case of the heat pump clothes dryer, creating a supply duct to the drum.

* * * * *